United States Patent [19]

Morgan, Jr. et al.

[11] 3,994,771

[45] Nov. 30, 1976

[54] PROCESS FOR FORMING A LAYERED PAPER WEB HAVING IMPROVED BULK, TACTILE IMPRESSION AND ABSORBENCY AND PAPER THEREOF

[75] Inventors: George Morgan, Jr.; Thomas F. Rich, both of Cincinnati, Ohio

[73] Assignee: The Procter & Gamble Company, Cincinnati, Ohio

[22] Filed: May 30, 1975

[21] Appl. No.: 582,521

[52] U.S. Cl. ..... 162/113; 162/123; 162/132; 428/154; 428/178; 428/180; 428/184; 428/186

[51] Int. Cl.[2] ..... D21H 5/24

[58] Field of Search ..... 162/111, 112, 113, 130, 162/117, 206, 123, 132, 131; 428/154, 178, 180, 184, 186

[56] References Cited

UNITED STATES PATENTS

| | | | |
|---|---|---|---|
| 1,969,938 | 8/1934 | Mosher | 162/112 |
| 2,018,382 | 10/1935 | Sale | 197/57 |
| 2,881,669 | 4/1959 | Thomas | 162/130 |
| 2,908,733 | 11/1937 | Sale | 260/679 |
| 2,996,424 | 8/1961 | Voightman et al. | 162/112 |
| 3,301,746 | 1/1967 | Sanford et al. | 162/117 |
| 3,424,643 | 1/1969 | Lewis et al. | 162/112 |
| 3,778,341 | 12/1973 | Plummer | 162/125 |
| 3,812,000 | 5/1974 | Salvucci et al. | 162/111 |
| 3,879,257 | 4/1975 | Gentile | 162/112 |
| 3,905,863 | 9/1975 | Ayers | 162/117 |

FOREIGN PATENTS OR APPLICATIONS

| | | | |
|---|---|---|---|
| 1,117,731 | 6/1968 | United Kingdom | |
| 149,758 | 8/1920 | United Kingdom | 162/112 |

*Primary Examiner*—S. Leon Bashore
*Assistant Examiner*—Peter Chin
*Attorney, Agent, or Firm*—E. Kelly Linman; Fredrick H. Braun; John V. Gorman

[57] ABSTRACT

A wet-laid composite, soft, bulky and absorbent paper structure is prepared from two or more layers of furnish which are preferably comprised of different fiber types. The layers are preferably formed from the deposition of separate streams of dilute fiber slurries, the fibers typically being relatively long softwood and relatively short hardwood fibers as used in tissue papermaking, upon one or more endless foraminous screens. The layers are subsequently combined to form a unitary web, and the layered, unitary web is dewatered by the application of fluid forces. The moist, layered web is thereafter transferred to an open mesh drying/imprinting fabric. The application of a fluid force to the web creates patterned discrete areas of fibers numbering from about 100 to about 3600 per square inch of projected surface area on the side of the web which contacts the drying/imprinting fabric. The undensified discrete areas which correspond to the mesh openings in the drying/imprinting fabric extend outwardly from the fabric side of the layered web and generally assume the form of totally-enclosed pillows, conically grouped arrays of fibers, combinations thereof or the like. Following transfer of the moist, layered paper web to the drying/imprinting fabric, the web is thermally predried to a fiber consistency of at least about 30 percent. The thermally predried, layered paper web may then be compacted in discrete areas corresponding to the knuckles of the drying/imprinting fabric to impart strength and to adhere the web to the surface of a dryer drum for final drying and/or creping. In the alternative, the thermally predried, layered paper web may be finally dried directly on the drying/imprinting fabric without any compaction by the fabric knuckles. In the latter event, the finally dried web is preferably subjected to mechaical micro-creping to impart softness, flexibility and drape to the fnished sheet. The above described layered structures exhibit significantly improved bulk, flexibility, compressibility, drape and absorptive capacity when compared to prior art paper sheets formed by similar processing techniques from a single slurry comprised of a homogeneous mixture of similar fibers. In addition, the structures which are stratified with respect to fiber type typically yield finished paper sheets having significantly improved tactile impression and softness.

52 Claims, 17 Drawing Figures

PROCESS FOR FORMING A LAYERED PAPER WEB HAVING IMPROVED BULK, TACTILE IMPRESSION AND ABSORBENCY AND PAPER THEREOF

FIELD OF THE INVENTION

The present invention relates to improvements in wet-laid and non-woven web manufacturing operations, especially those utilized for producing soft, bulky, and absorbent paper sheets suitable for use in tissue, towelling and sanitary products. In particular, the present invention relates to the provision of a layered composite web formed from individual fiber slurries, said layered web being subsequently caused to conform to the surface of an open mesh drying/imprinting fabric by the application of a fluid force to the web and thereafter thermally predried on said fabric as part of a lowdensity papermaking process. The layered web may be stratified with respect to fiber type or the fiber content of the respective layers may be essentially the same.

Unexpectedly, sheets produced by processing a moist, layered paper web as described herein exhibit improved bulk and caliper when compared to similarly-processed, non-layered structures comprised of a homogeneous mixture of similar fibers. In addition, paper sheets of the present invention are generally perceived as having improvements in softness and tactile impression, particularly on the surface of the sheet having discrete patterned arrays of fibers extending outwardly therefrom, along with improved overall flexibility and drape. Because of their greater void volume, i.e., lower overall density, layered paper sheets of the present invention also have particular relevance to soft, bulky paper sheets exhibiting improved absorptive capacity.

BACKGROUND OF THE INVENTION

In the conventional manufacture of paper sheets for use in tissue, towelling and sanitary products, it is customary to perform, prior to drying, one or more overall pressing operations on the entire surface of the paper web as laid down on the Fourdrinier wire or other forming surface. Conventionally, these overall pressing operations involve subjecting a moist paper web supported on a papermaking felt to pressure developed by opposing mechanical members, for example, rolls. Pressing generally accomplishes the triple function of mechanical water expulsion, web surface smoothing and tensile strength development. In most prior art processes, the pressure is applied continuously and uniformly across the entire surface of the felt. Accompanying the increase in tensile strength in such prior art papermaking processes, however, is an increase in stiffness and overall density.

Furthermore, the softness of such conventionally formed, pressed and dried paper webs is reduced not only because their stiffness is increased as a result of increased interfiber hydrogen bonding, but also because their compressibility is decreased as a result of their increased density. Creping has long been employed to produce an action in the paper web which disrupts and breaks many of the interfiber bonds already formed in the web. Chemical treatment of the papermaking fibers to reduce their interfiber bonding capacity has also been employed in prior art papermaking techniques.

A significant advance in producing lower density paper sheets, however, is disclosed in U.S. Pat. No. 3,301,746 which issued to Sanford et al. on Jan. 31, 1967, said patent being hereby incorporated herein by reference. The aforesaid patent discloses a method of making bulky paper sheets by thermally predrying a web to a predetermined fiber consistency while supported on a drying/imprinting fabric and impressing the fabric knuckle pattern in the web prior to final drying. The web is preferably subjected to creping on the dryer drum to produce a paper sheet having a desirable combination of softness, bulk, and absorbency characteristics.

Other papermaking processes which avoid compaction of the entire surface of the web, at least until the web has been thermally predried, are disclosed in U.S. Pat. No. 3,812,000 which issued to Salvucci, Jr. et al. on May 21, 1974; U.S. Pat. No. 3,821,068 which issued to Shaw on June 28, 1974; and U.S. Pat. No. 3,629,056 which issued to Forrest on Dec. 21, 1971, the aforesaid patents being hereby incorporated herein by reference.

All of the aforementioned patents disclose lowdensity papermaking processes and products wherein the web is not stratified. Applicants, however, have unexpectedly discovered that layering of papermaking fibers to form a stratified web can be employed to particular advantage when utilized in combination with such low-density papermaking processes. This is accomplished by subjecting the web to a fluid force while supported on an intermediate drying/imprinting fabric at relatively low fiber consistencies to produce soft, bulky and absorbent paper sheets of unusually high caliper and unusually low density, said paper sheets being particularly suitable for use in tissue, towelling and similar products.

OBJECTS OF THE INVENTION

Accordingly, it is an object of the present invention to provide an improved soft, bulky and absorbent paper sheet formed by layering similar or dissimilar fiber types, said paper sheet being characterized by an unexpectedly lower density than similarly-produced, non-layered, prior art paper structures comprised of a homogeneous mixture of similar papermaking fibers.

It is another object of the present invention to provide a low-density, layered paper sheet exhibiting adequate tensile strength for use in tissue, towelling and similar products, said layered paper sheet also exhibiting improved bulk, flexibility, compressibility, drape, and absorptive capacity when compared to similarly-processed, non-layered prior art paper structures comprised of a homogeneous mixture of similar papermaking fibers.

It is another object of the present invention to provide layered paper sheets having improved tactile impression and softness.

It is yet another object of the present invention to provide a method for forming such low-density paper sheets.

SUMMARY OF THE INVENTION

Paper sheets of the present invention are generally comprised of at least two superposed stratified fibrous layers in contacting relationship for a major portion of their areas, at least one of said stratified layers being partially displaced in small discrete deflected areas corresponding to the mesh openings of the fabric on which said web is supported during thermal predrying.

In a particularly preferred embodiment of the present invention, a soft, bulky and absorbent paper sheet is provided, said sheet having one surface thereof comprised primarily of relatively long papermaking fibers and the opposite surface thereof comprised primarily of relatively short papermaking fibers, said sheet exhibiting an unexpectedly lower density than a similarly-produced, non-layered prior art paper sheet comprised of a homogeneous mixture of said long and short papermaking fibers, without a corresponding loss in overall tensile strength.

In general, soft, bulky and absorbent paper sheets of the present invention are produced by forming a moist paper web comprising at least two superposed stratified layers in contacting relationship, supporting said web on a foraminous drying/imprinting fabric, subjecting said web to a pressure differential while on said fabric, thereby displacing at least one of said stratified layers in a plane perpendicular to said sheet in small discrete deflected areas corresponding to the mesh openings in said fabric, and final drying said sheet without disturbing the aforesaid deflected areas.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings, in which:

DESCRIPTION OF THE PREFERRED EMBODIMENTS

Figure 1:
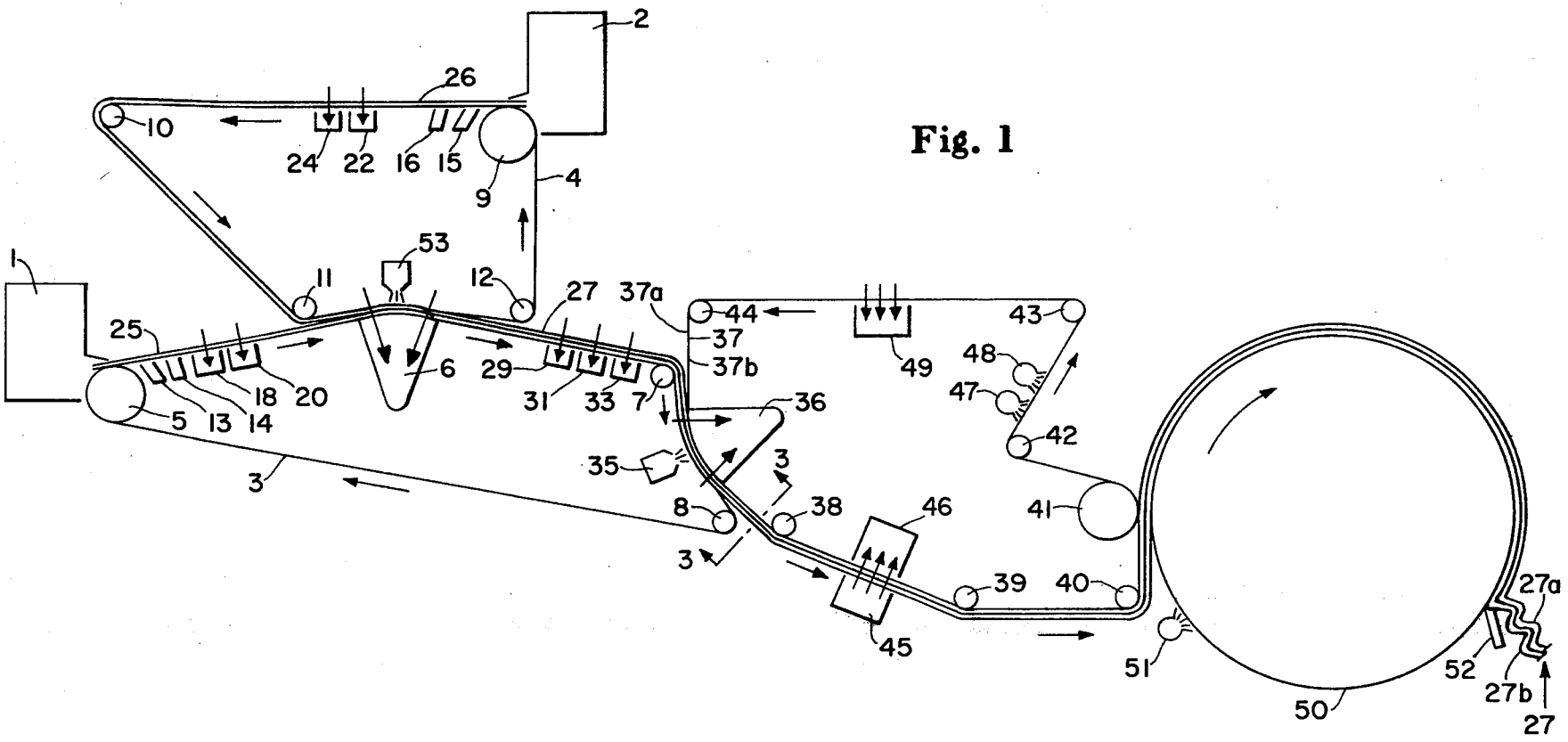
FIG. 1 is a schematic illustration of a preferred embodiment of a papermaking machine suitable for producing a low-density, two-layered paper sheet of the present invention.

FIG. 1 is a schematic illustration of a preferred embodiment of a papermaking machine for forming a low-density, multi-layered paper sheet of the present invention. The basic layout of the papermaking machine illustrated in FIG. 1 is generally in accordance with the teachings of U.S. Pat. No. 3,301,746 which issued to Sanford et al. on Jan. 31, 1967. The papermaking machine illustrated in FIG. 1, however, employs an additional headbox and forming system to enable formation of a fibrous web which may be stratified with respect to fiber type.

In the embodiment illustrated in FIG. 1, a papermaking furnish comprised primarily of relatively long papermaking fibers, i.e., preferably softwood pulp fibers having an average length of at least about 0.08 inches, and preferably between about 0.08 inches and about 0.12 inches, is delivered from a headbox 1 to a fine mesh Fourdrinier wire 3 supported by a breast roll 5. A moist paper web 25 comprised of said long papermaking fibers is formed, and the Fourdrinier wire 3 passes over forming boards 13 and 14, which are desirable but not necessary. The paper web 25 and the Fourdrinier wire 3 then pass over a plurality of vacuum boxes 18 and 20 to remove water from the web and increase the web's fiber consistency.

A secondary papermaking furnish comprised primarily of relatively short papermaking fibers, i.e., preferably hardwood pulp fibers having an average length between about 0.01 inches and about 0.06 inches, is delivered from a second headbox 2 to a second fine mesh Fourdrinier wire 4 supported by a breast rool 9. A second moist paper web 26 comprised of said short papermaking fibers is formed, and the Fourdrinier wire 4 passes over forming boards 15 and 16 and a plurality of vacuum boxes 22 and 24 to increase the web's fiber consistency.

The moist hardwood web 26 and Fourdrinier wire 4 thereafter pass around Fourdrinier wire return rolls 10 and 11, and the outermost surface of web 26 is preferably brought into intimate contact with the outermost surface of the softwood web 25 while each of said webs is at the lowest feasible fiber consistency to encourage effective bonding between the webs. The aforesaid transfer preferably occurs at fiber consistencies between about 3 percent and about 20 percent. At fiber consistencies lower than about 3 percent, an uncompacted paper web is easily damaged during transfer from a fine mesh Fourdrinier wire to the surface of another fibrous web, while at fiber consistencies above about 20 percent, it becomes more difficult to securely bond the respective layers into a unitary structure merely by the application of fluid pressure thereto.

Transfer of the hardwood web 26 to the outermost surface of the softwood web 25 is preferably accomplished by the application of vacuum. If desired, steam jets, air jets, etc. may be employed either alone or in combination with vacuum to effect transfer of the moist web. As illustrated in FIG. 1, this is accomplished, in a preferred embodiment of the present invention, intermediate a stationary vacuum transfer box 6 and an optional slotted steam nozzle 53. At this point the moist hardwood web 26 is transferred from the uppermost Fourdrinier wire 4 to the outermost surface of the moist softwood web 25 to form a composite web 27 which is essentially stratified with respect to fiber type. Subsequent to the transfer, the composite web 27 is passed over a plurality of vacuum boxes 29, 31 and 33 to increase its overall fiber consistency and form it into a unitary structure. The uppermost Fourdrinier wire 4, after transfer of the hardwood web 26, passes around Fourdrinier wire return roll 12 and, after suitable cleaning, guiding and tensioning which are not shown, returns to the uppermost breast roll 9.

As is illustrated in FIG. 1, the composite web 27 is carried on Fourdrinier wire 3 around wire return roll 7 and is brought in contact with a coarser mesh drying-/imprinting fabric 37 which has its undersurface **37*b* contiguous to a vacuum pickup shoe 36 in such a manner that the uppermost surface 27*a* of the composite paper web 27, i.e., the surface containing primarily short papermaking fibers, is placed in contact with the web supporting surface 37*a* of the drying/imprinting fabric 37. If desired, a slotted steam nozzle 35 may be provided to assist in transferring the web to the fabric. The surface of the web 27*a* contacting the web supporting surface 37*a* of the fabric 37 shall, for convenience, hereinafter be referred to as the fabric side of the web, while the surface of the web contacting the Fourdrinier wire 3 shall hereinafter be referred to as the wire side 27*b*** of the web.

Because the bulk and caliper increases obtained in multi-layered sheets produced in accordance with the present invention is derived primarily from reorientation and penetration of the fibers on the fabric side of the composite web 27 into the mesh openings of the drying/imprinting fabric 37, transfer of the composite moist paper web 27 from the Fourdrinier wire 3 to the fabric 37 is extremely critical. Applicants have learned that a significant degree of fiber reorientation and fiber penetration into the mesh openings of the drying/imprinting fabric 37 can generally be achieved utilizing a vacuum pickup shoe 36, as shown in FIG. 1, at composite web fiber consistencies between about 5 and about 25 percent. At fiber consistencies lower than about 5 percent, the composite web 27 possesses little strength and is easily damaged during transfer from the fine mesh Fourdrinier wire to the coarser mesh drying/imprinting fabric merely by application of fluid pressure in the form of vacuum, steam jets, air jets, etc.

Where vacuum is employed, the vacuum applied to the web should be sufficient to cause the fibers on the fabric side of the web to reorient themselves and to penetrate the fabric mesh openings, yet not excessive so as to remove a significant quantity of fibers from the fabric side of the web by pulling them completely through the fabric mesh openings and into the vacuum pickup shoe. While the actual level of vacuum applied to the web to achieve the desired degree of fiber reorientation and fiber penetration will vary, depending upon such factors as web composition, pickup shoe design, machine speed, fabric design and mesh count, fiber consistency at transfer, etc., applicants have typically obtained good results utilizing vacuum levels between about 5 and about 15 inches of mercury.

While applicants do not wish to be held to this theory, the greater degree of fiber reorientation and fiber penetration which account for the increase in caliper, i.e. the decrease in density, of multi-layered paper sheets of the present invention is believed to be due to the tendency of the layers of composite webs to separate from one another and react as a series of weaker independent webs while moist, at least in respect to deflection and/or repositioning of the fibers thereof. Thus, the application of fluid pressure to a layered paper web at relatively low fiber consistency while the web is being supported on a drying/imprinting fabric results in a greater degree of penetration into the mesh openings of the fabric by the fibers in contact therewith.

Figure 2:
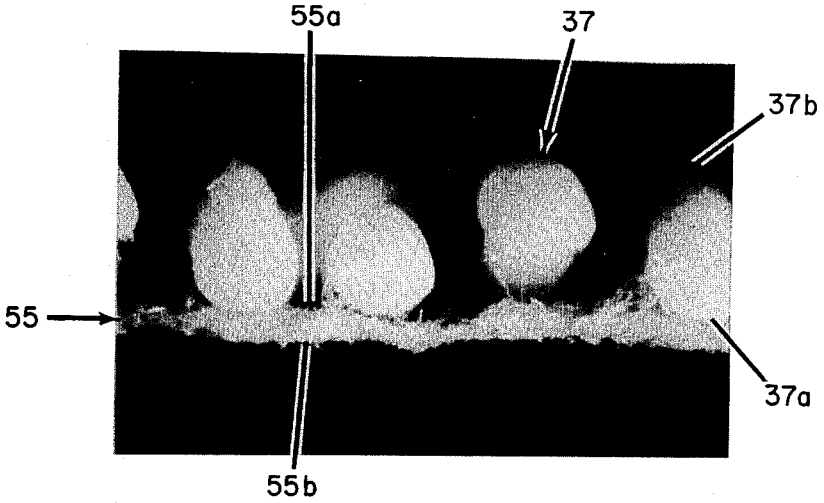
FIG. 2 is a cross-sectional photograph enlarged about 20 times actual size of a handsheet taken at a point corresponding to that of section line 3—3 in FIG. 1 and illustrating generally the degree of molding or penetration of the drying/imprinting fabric by a non-layered prior art paper web comprised of a homogeneous mixture of relatively long softwood pulp and relatively short hardwood pulp fibers.

FIG. 2 is a cross-sectional photograph enlarged about 20 times actual size of a non-layered prior art handsheet 55 comprised of a homogeneous mixture of relatively long papermaking fibers and relatively short papermaking fibers, said cross-sectional view being taken at a point corresponding to that of section line 3—3 in FIG. 1. The particular drying/imprinting fabric shown is of the semi-twill variety, said fabric having been treated generally in accordance with the teachings of the commonly owned patent application of Peter G. Ayers, Ser. No. 457,043, filed Apr. 1, 1974 and entitled PROCESS FOR FORMING ABSORBENT PAPER BY IMPRINTING A SEMI-TWILL FABRIC KNUCKLE PATTERN THEREON PRIOR TO FINAL DRYING AND PAPER THEREOF, now U.S. Pat. No. 3,905,863 said application and said patent being hereby incorporated herein by reference. The same basic principles are, however, equally applicable to any foraminous fabric suitable for thermally predrying and/or imprinting a web generally in accordance with the teachings of the aforementioned patent to Sanford et al. The enlaged cross-section of FIG. 2 illustrates the tendency of a prior at non-layered web to behave as a unitary structure and the tendency of the relatively long, randomly distributed papermaking fibers on the fabric side 55*a* of the web to bridge across the fabric mesh openings formed by intersecting and adjacent woof and warp monofilaments. As can also be seen in FIG. 2, the wire side 55*b* of the non-layered web 55 remains substantially planar and continuous. In accordance with the fabric terminology utilized herein, woof filaments are those extending generally in the crossmachine direction, while warp filaments are those extending generally in the machine direction.

Figure 3:
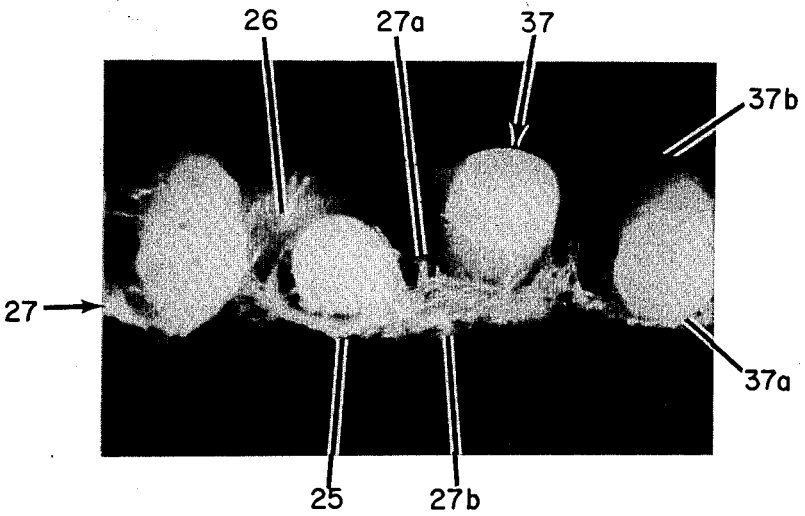
FIG. 3 is a cross-sectional photograph enlarged about 20 times actual size of a handsheet taken at a point corresponding to that of section line 3—3 in FIG. 1 illustrating the degree of molding or penetration of the drying/imprinting fabric by a stratified web comprised primarily of relatively short hardwood pulp fibers on the surface of the web in contact with the drying/imprinting fabric and primarily of relatively long softwood pulp fibers on its opposite surface.

FIG. 3 is a cross-sectional photograph enlaged about 20 times actual size of a layered handsheet 27 of the present invention, said cross-sectional view being taken at a point corresponding to that of section line 3—3 in FIG. 1. The short-fibered portion 26 of the composite web 27 is partially displaced in a plane perpendicular to the web in small discrete deflected areas corresponding to the mesh openings in the drying/imprinting fabric, while the long-fibered portion 25 remains substantially planar and continuous, thus providing strength and integrity in the resultant paper sheets 27. As should be apparent from FIG. 3, the short papermaking fibers on the surface of the web in contact with the web supporting surface 37*a* of the drying/imprinting fabric 37 have less tendency to bridge across the mesh openings in the fabric.

In a particularly preferred embodiment of the present invention, the fabric is characterized by a diagonal free span, i.e., the planar distance as measured from one corner of a projected fabric mesh opening to its diagonally opposite corner, between about 0.005 inches and about 0.080 inches, most preferably between about 0.009 inches and about 0.054 inches, and a fabric mesh count of between about 100 and about 3,600 openings per square inch, i.e., said fabric having between about 10 and about 60 filaments per inch in both the machine and cross-machine directions. Particularly advantageous results have been obtained in the practice of the present invention with the knuckle pattern produced by the back side of a semi-twill drying/imprinting fabric of the type shown in FIGS. 2 and 3.

In a long-fibered/short-fibered web embodiment of the type shown in FIG. 3, it is preferable that the diagonal free span of the drying/imprinting fabric be less than about the average fiber length in the short-fibered strata of the web. If the diagonal free span is greater than the average fiber length in the short-fibered strata of the web, the fibers are too easily pulled through the fabric mesh openings when subjected to fluid pressure, thereby detracting from the bulk and caliper of the finished sheets. On the other hand, the diagonal free span of the fabric is preferably greater than about one third, and most preferably greater than about one half, the average fiber length in the short-fibered strata of the web in order to minimize bridging of the short fibers across the fabric filaments. In addition, the diagonal free span of the fabric is preferably less than about one third the average fiber length in the long-fibered strata of the web in order to encourage bridging of the long fibers across at least one pair of fabric filaments. Accordingly, in a web embodiment of the type shown in FIG. 3, the short fibers tend to reorient themselves and penetrate the fabric mesh openings during transfer of the moist stratified web to the drying/imprinting faric while the long fibers tend to bridge the openings and remain substantially planar.

As has been alluded to earlier herein, the patterned discrete areas which correspond to the fabric mesh openings and which extend outwardly from the fabric side of a web of the type generally shown in FIG. 3 typically assume the form of totally enclosed pillows, conically grouped arrays of fibers, or a combination thereof. The wire side of the web which remains substantially continuous and planar exhibits an uninterrupted patterned surface similar to the textile pique'.

Figure 12:
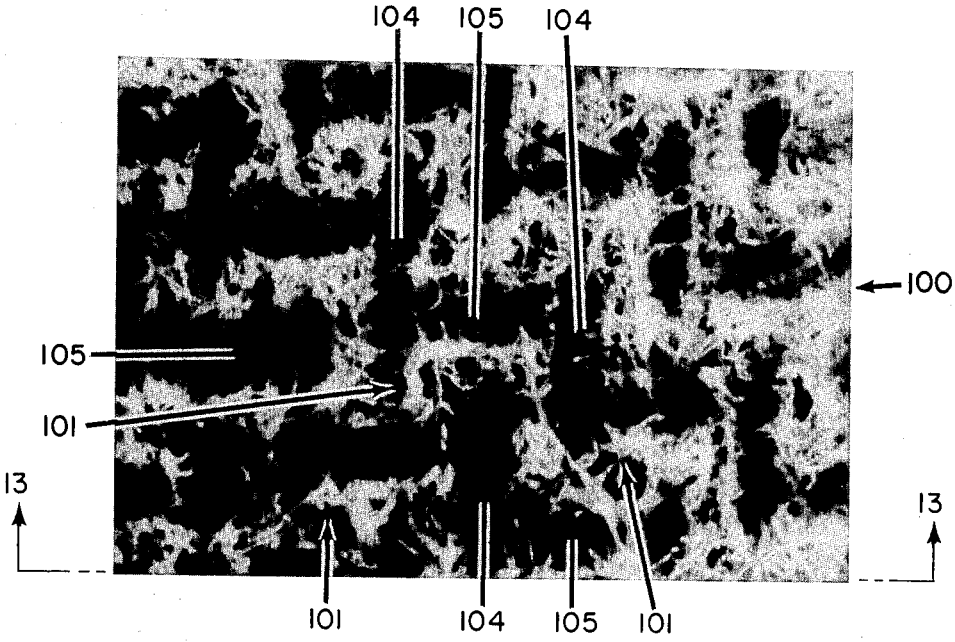
FIG. 12 is a photographic plan view enlarged about 20 times actual size of the fabric side of an uncreped, layered paper web of the present invention having a fiber composition and layer orientation similar to that of the paper sheet shown in FIG. 10, said web having been removed from the drying/imprinting fabric prior to compaction thereof between the knuckles of the fabric and the dryer drum.
Figure 16:
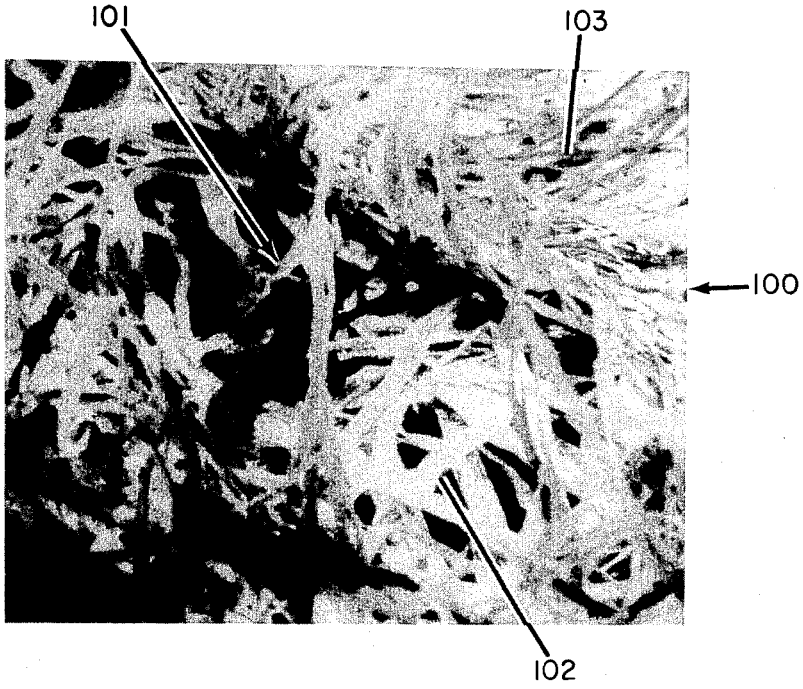
FIG. 16 is a photographic perspective view enlarged about 100 times actual size of one of the volcano-like cone structures formed in an uncreped, layered paper web of the present invention.

FIG. 12 is a plan view photograph enlarged about 20 times actual size of the fabric side 100*a* of an uncreped, layered paper web 100, of the type generally described above, said web having been subjected to fluid pressure and thermally predried on a 31 × 25 semi-twill drying-/imprinting fabric prepared as described in the aforementioned patent of Peter G. Ayers and removed from the fabric prior to compaction thereof between the knuckles of the fabric and the dryer drum. The web 100 is comprised of approximately 50 percent softwood fibers and 50 percent hardwood fibers, the hardwood fiber strata 103 (FIG. 13) being located on the fabric side 100*a* of the web and the softwood strata 102 being located on the wire side 100*b* of the web. The impressions 104 of the woof monofilaments extending generally in the cross-machine direction and the impressions 105 of the warp monofilaments extending generally in the machine direction are both clearly apparent in FIG. 12. As is also apparent from FIG. 13, discrete areas of the short-fibered strata 103 are perpendicularly deflected from the long-fibered strata 102 of the web, said discrete areas exhibiting a tendency to wrap themselves about the filaments of the fabric when subjected to fluid pressure to form volcano-like cone structures 101 comprised primarily of short fibers extending in a direction generally perpendicular to the web. FIG. 16 is a perspective photographic view enlaged about 100 times actual size of a volcano-like cone structure 101 of the type formed in the hardwood strata 103 of the substantially uncompacted, layered paper web 100 shown in FIGS. 12 and 13. The continuity of the softwood strata 102 at the base of the volcano-like structure is clearly visible. Thus the fabric side of the resultant layered paper web exhibits the negative image of the web supporting surface of the drying/imprinting fabric, while the pique'-like wire side of the layered paper web exhibits, at least to an extent, the positive image of the web supporting surface of the fabric.

Figure 13:
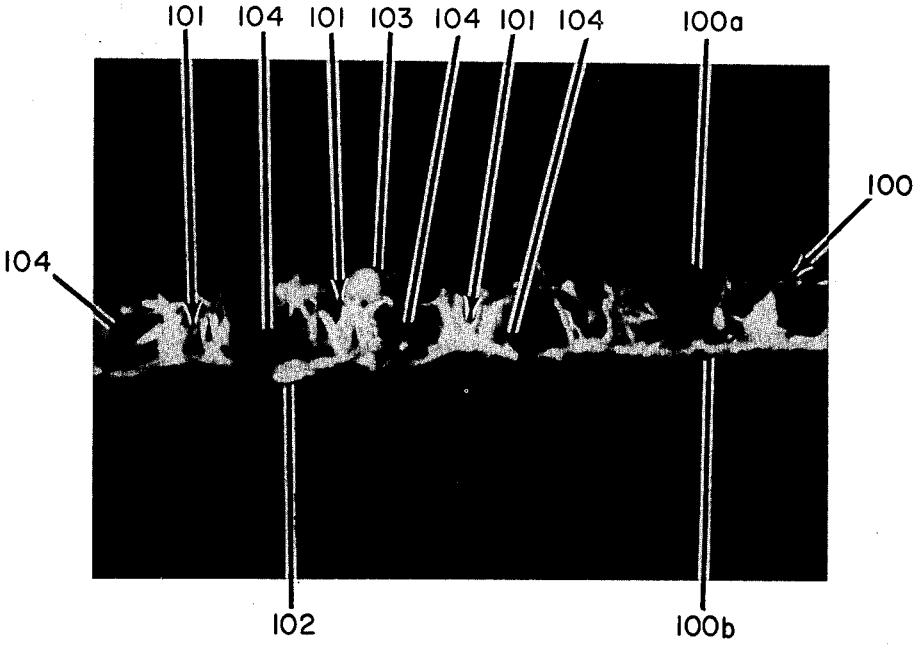
FIG. 13 is an enlarged photographic sectional view of the uncreped, layered paper web shown in FIG. 12 taken looking in the cross-machine direction along section line 13—13 in FIG. 12.

Because the long-fibered strata of the stratified web remains substantially continuous and planar, the overall tensile strength and integrity of the resulting finished paper sheets do not differ significantly from similarly-produced non-layered sheets formed from a single homogeneously mixed slurry of similar fibers. The reorientation and deflection of discrete arrays of short fibers in a direction perpendicular to the plane of the web does result, however, in a significant increase in the overall bulk and caliper of such layered paper sheets. Because of their greater interstitial void volume, i.e., lower overall density, the layered sheets exhibit improved total absorptive capacity in addition to improved flexibility, drape and compressibility. Such finished paper sheets are also generally perceived as having significantly improved tactile impression on the fabric side of the web, as well as improved overall softness. This is believed due not only to the reorientation and isolation of the short fibers on the fabric side of the web, but also to the overall reduction in web density. As can be seen in FIG. 13, such layered sheets exhibit a density gradient from one side of the sheet to the other, resulting in a liquid absorption gradient which makes one side of the sheet feel drier to the touch than the other side. This is due to the fact that liquid is transmitted by capillary attraction from the less dense short-fibered side of the sheet to the more dense long-fibered side of the sheet and is retained therein due to the existence of a favorable capillary size gradient between the two layers.

Figure 6:
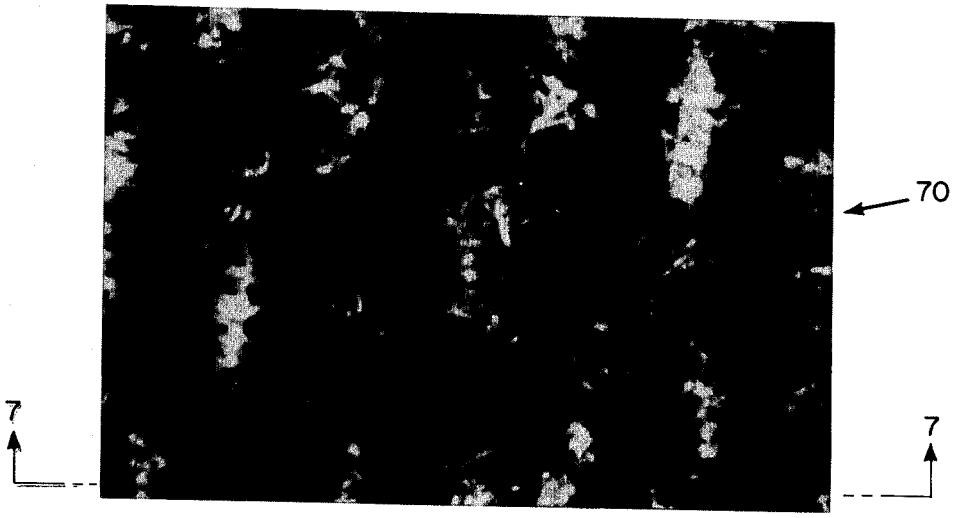
FIG. 6 is a photographic plan view enlarged about 20 times actual size of the fabric side of one embodiment of a layered, creped paper sheet of the present invention produced generally in accordance with the process illustrated in FIG. 1, said sheet being formed from two identical slurries of essentially the same fiber content, each slurry containing approximately 50 percent softwood and 50 percent hardwood fibers in a homogeneous mixture.
Figure 7:
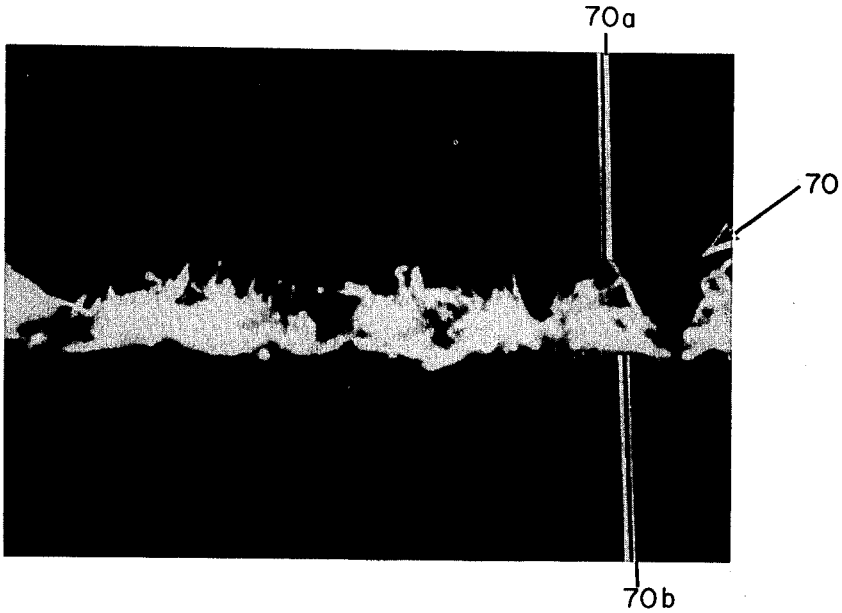
FIG. 7 is an enlarged photographic sectional view of the layered, creped paper sheet shown in FIG. 6 taken looking in the cross-machine direction along section line 7—7 in FIG. 6.
Figure 8:
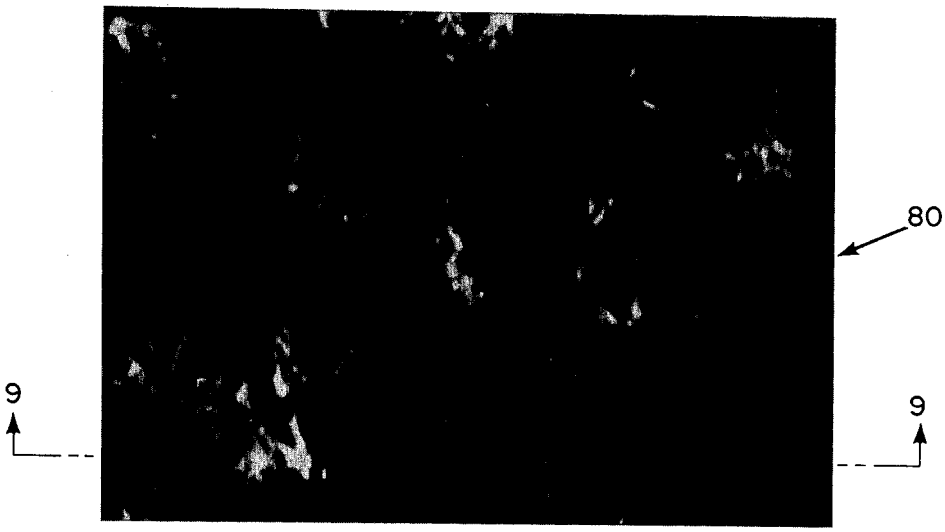
FIG. 8 is a photographic plan view enlarged about 20 times actual size of the fabric side of another embodiment of a layered, creped paper sheet of the present invention produced generally in accordance with the process illustrated in FIG. 1, said sheet being formed from a slurry of softwood fibers on its fabric side and a slurry of hardwood fibers on its wire side, the total fiber content of said sheet being approximately 50 percent softwood and 50 percent hardwood fibers.
Figure 9:
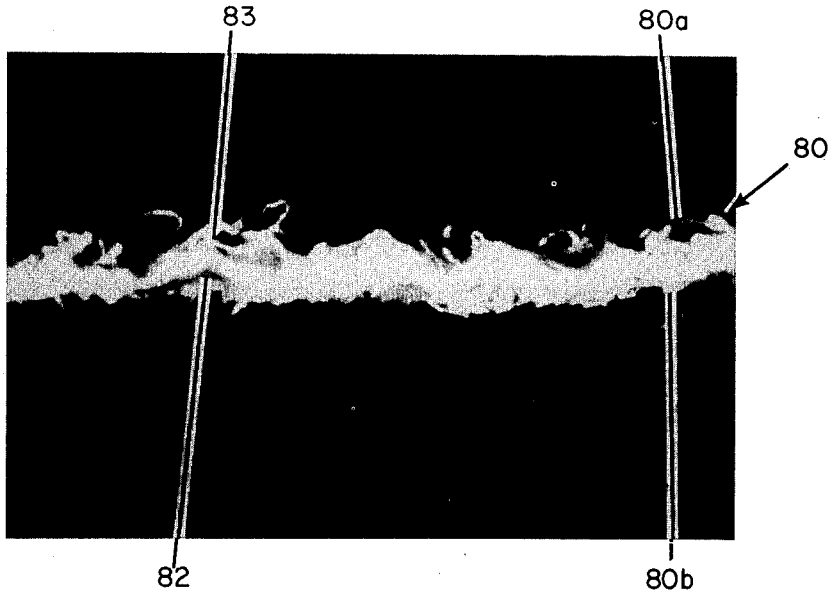
FIG. 9 is an enlarged photoraphic sectional view of the layered, creped paper sheet shown in FIG. 8 taken looking in the cross-machine direction along section line 9—9 in FIG. 8.

While long-fibered/short-fibered webs of the type generally shown in FIG. 3 represent a most preferred embodiment of the present invention, applicants have unexpectedly discovered that similar improvements in bullk and caliper may also be obtained, although to a lesser degree, by layering homogeneously mixed stratas of long and short fibers on one another as shown in FIGS. 6 and 7, by layering identical long-fibered stratas on one another, by layering identical short-fibered stratas on one another, and even by layering long and short papermaking fibers in the reverse order from that described above, i.e., so that the long-fibered strata is on the fabric side of the web as shown in FIGS. 8 and 9. It should be noted, however, that when the fiber content of the strata in contact with the drying/imprinting fabric, i.e., the fabric side of the web, is essentially the same as that of the strata opposite the drying/imprinting fabric, i.e., the wire side of the web, both stratas may be generally displaced in a plane perpendicular to the sheet. In the latter situation, the patterned discrete areas of fibers extending outwadly from the fabric side of the sheet may create discontinuities which extend throughout the entire thickness of the web, which discontinuities are more clearly apparent from both sides of the resultant paper structure.

The latter embodiments of the present invention are, however, generaly less preferred since, in most instances, they fail to exhibit all of the other unique properties exhibited by long-fibered/short-fibered stratified webs of the type generally shown in FIG. 3.

Following transfer of the composite paper web 27 to the drying/imprinting fabric 37, the Fourdrinier wire 3 is passed about wire return roll 8, through suitable cleaning, guiding and tensioning apparatus which are not shown, and back to the lowermost breast roll 5. The drying/imprinting fabric 37 and the layered paper web 27 are directed about direction-changing roll 38 and pass through a hot air, blow-through dryer illustrated schematically at 45 and 46, where the layered paper web is thermally predried without disturbing its relationship to the drying/imprinting fabric 37. Hot air is preferably directed from the wire side 27b of the layered paper web 27 through the web and the drying/imprinting fabric 37 to avoid any adverse effect on penetration of the fabric mesh openings by the relatively short papermaking fibers located on the fabric side 27*a* of the web. U.S. Pat. No. 3,303,576 which issued to Sisson on Feb. 14, 1967 and which is hereby incorporated herein by reference discloses a preferred apparatus for thermally predrying the layered paper web 27. Although the exact means by which thermal predrying is accomplished is not critical, it is critical that the relationship of the moist paper web 27 to the drying-/imprinting fabric 37 be maintained once established, at least while the web is at relaively low fiber consistency.

According to U.S. Pat. No. 3,301,746, thermal predrying is preferably used to effect a web fiber consistency in the moist paper web of from about 30 percent to about 80 percent. Based on the copending, commonly-assigned patent application of Gregory A. Bates, Ser. No. 452,610, filed Mar. 19, 1974 and entitled TRANSFER AND ADHERENCE OF RELATIVELY DRY PAPER WEB TO A ROTATING CYLINDRICAL SURFACE, now U.S. Pat. No. 3,926,716 said application and said patent being commonly owned by the assignee of the present invention and hereby incorporated herein by reference, it is now known that web fiber consistencies as high as about 98 percent are feasible.

Following thermal predrying to the desired fiber consistency, the drying/imprinting fabric 37 and the thermally predried, composite paper web 27 pass over a straightening roll 39 which prevents the formation of wrinkles in the drying/imprinting fabric, over a fabric return roll 40, and preferably onto the surface of a Yankee dryer drum 50. Spray nozzles 51 are preferably utilized to apply a small amount of adhesive to the surface of the dryer drum 50, as is more fully described in the aforementioned patent application of Gregory A. Bates. The fabric knuckles on the web supporting surface 37*a* of the drying/imprinting fabric 37 are, in a preferred embodiment of the present invention, utilized to compact discrete portions of the thermally predried, paper web 27 by passing the fabric and the web through the nip formed between a pressure roll 41 and the Yankee dryer drum 50. The drying/imprinting fabric 37, after transfer of the web to the Yankee dryer drum 50, returns to the vacuum pickup shoe 36 over fabric return rolls 42, 43, and 44, said drying/imprinting fabric being washed free of clinging fibers by water sprays 47 and 48 and dried by means of a vacuum box 49 during its return. After compaction between the fabric knuckles and the dryer drum, the thermally predried, layered paper web 27 continues from the nip formed between the pressure roll 41 and the Yankee dryer drum 50 along the periphery of the Yankee dryer drum 50 for final drying and is preferably creped from the Yanker surface by means of a doctor blade 52.

In yet another embodiment of the present invention, the compaction step between the fabric knuckles and the dryer drum is completely eliminated. The moist layered paper web 27 is finally dried in place directly on the drying/imprinting fabric 37. Upon removal from the drying/imprinting fabric 37, the layered paper web is preferably subjected to any one of a number of processes designed to provide acceptable stretch, softness and drape in the finished sheet, e.g., mechanical micro-creping carried out between differentially loaded rubber belts and/or a differentially loaded rubber belt and a hard surface. Such mechanical micro-creping processes are generally known in the papermaking industry. In a particularly preferred embodiment of the present invention, the finally dried, layered paper web is confined between a rubber belt at varying tensions and a pulley face to produce micro-creping in a system similar to that disclosed in U.S. Pat. No. 2,624,245 issued to Cluett on Jan. 6, 1953, and popularly known as "Clupaking", said patent being hereby incorporated herein by reference.

While omission of the aforementioned knuckle compaction step and inclusion of mechanical micro-creping may have an adverse effect on the overall tensile strength of the paper sheets, the reduction in strength is generally not so great as to render the finished sheets unsuitable for use in tissue, towelling and similar products. In addition, the overall tensile strength of the such layered paper sheets can normally be adjusted upwardly, as desired, by subjecting the longer papermaking fibers to additional refining prior to web formation, thereby increasing their tendency to form papermaking bonds. Dry strength additives well known in the papermaking industry may also be employed for this purpose.

Figure 4:
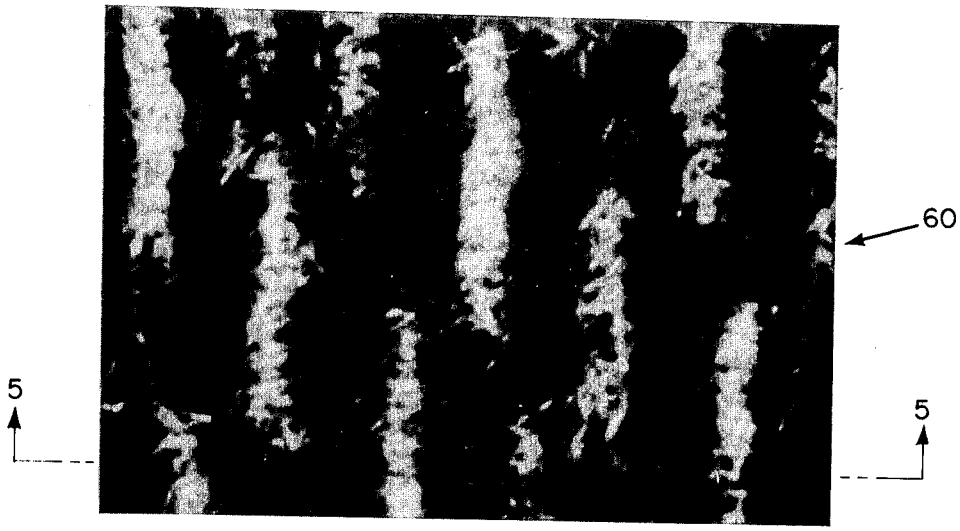
FIG. 4 is a photographic plan view enlarged about 20 times actual size of the fabric side of a prior art creped paper sheet processed generally in accordance with the teachings of U.S. Pat. No. 3,301,746, said sheet being formed from a single, homogeneously mixed slurry containing approximately 50 percent softwood and 50 percent hardwood fibers.
Figure 5:
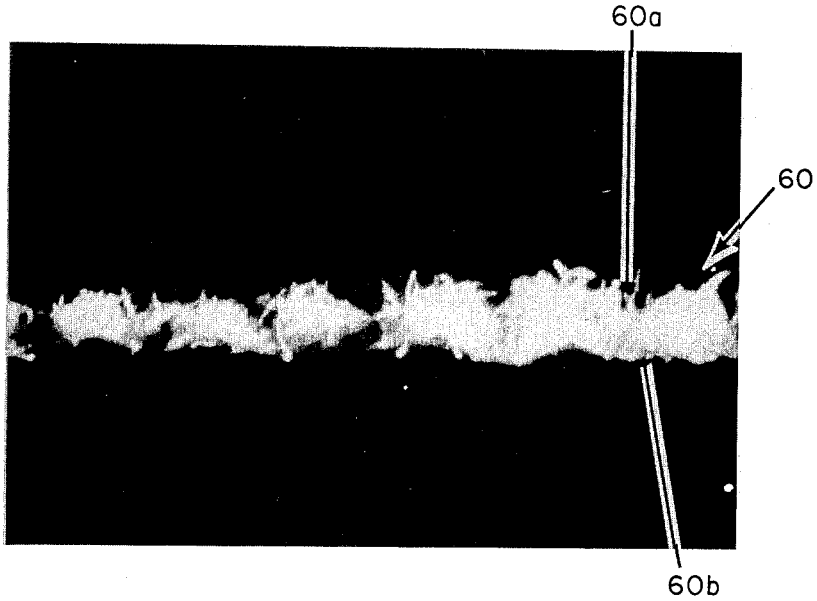
FIG. 5 is an enlarged photographic sectional view of the creped paper sheet shown in FIG. 4 taken looking in the cross-machine direction along section line 5—5 in FIG. 4.

FIG. 4 is a photographic plan view enlarged about 20 times actual size of the fabric side of a prior art, non-layered, creped paper sheet 60 processed generally in accordance with the teachings of U.S. Pat. No. 3,301,746, said sheet being formed from a single, homogeneously mixed slurry containing approximately 50 percent softwood and 50 percent hardwood fibers. The sheet as subjeted to fluid pressure and thermally predried on a 26 × 22 semi-twill drying/imprinting fabric prepared as described in the aforementioned patent of Peter G. Ayers, compacted by the fabric knuckles upon transfer to a Yankee dryer drum, finally dried, and creped upon removal from the drum by means of a doctor blade. The finished sheet contains approximately 16 percent crepe. As shown in FIG. 5, the sheet has the appearance of a lazy corrugation with only a minor portion of the fibers on the fabric side 60*a* of the sheet extending outwardly away from the surface of the sheet when viewed in the cross-machine direction.

FIG. 6 is a plan view enlarged about the same extent as FIG. 4 of the fabric side 70*a* of a layered, creped paper sheet 70 of the present invention produced generally in accordance with the process illustrated in FIG. 1, said sheet being formed from two identical slurries of essentially the same fiber content, each slurry containing approximately 50 percent softwood and 50 percent hardwood fibers in a homogeneous mixture. The basis weights, processing conditions, drying/imprinting fabric, and degree of crepe were essentially the same as those of the non-layered prior art sheet shown in FIGS. 4 and 5. As should be apparent from a comparison of FIGS. 5 and 7, the fabric side 70*a* of the layered sheet has a greater proportion of its fibers deflected outwardly in a direction generally away from the plane of the sheet. Thus, the layered paper sheet 70 shown in FIGS. 6 and 7 exhibits a greater overall caliper and consequently a lower density than the similarly-produced, non-layered prior at sheet 60 shown in FIGS. 4 and 5.

FIG. 8 is a photographic plan view enlaged about 20 times actual size of the fabric side 80*a* of a layered, creped paper sheet 80 of the present invention produced generally in accordance with the process illustrated in FIG. 1, said sheet being formed, from a slurry of softwood fibers 83 on its fabric side 80*a* and a slurry of hardwood fibers 82 on its wire side 80*b*, the total fiber content of said sheet being approximately 50 percent softwood and 50 percent hardwood fibers. The basis weights, processing conditions, drying/imprinting fabric, and degree of crepe were essentially the same as those of the sheets shown in FIGS. 4 – 7. A comparison of FIGS. 9 and 5 reveals that the fabric side 80*a* of the sheet has a greater proportion of its fibers deflected outwardly in a direction generally away from the plane of the sheet. It should be noted, however, that the degree of deflection of the reoriented fibers as well as the proportion of fibers affected appears to be less pronounced than for the sheet 70 shown in FIG. 7. This is believed to be due to the lower fiber mobility in the long-fibered strata 83 and the greater tendency of the long fibers to bridge across the fabric mesh openings of the drying/imprinting fabric when compared to a layer comprised either of short fibers or a homogeneous mixture of short and long fibers. Nonetheless, the layered paper sheet 80 illustrated in FIGS. 8 and 9 exhibits a greater overall caliper and consequently a lower density than the non-layered prior at sheet 60 shown in FIGS. 4 and 5.

Figure 10:
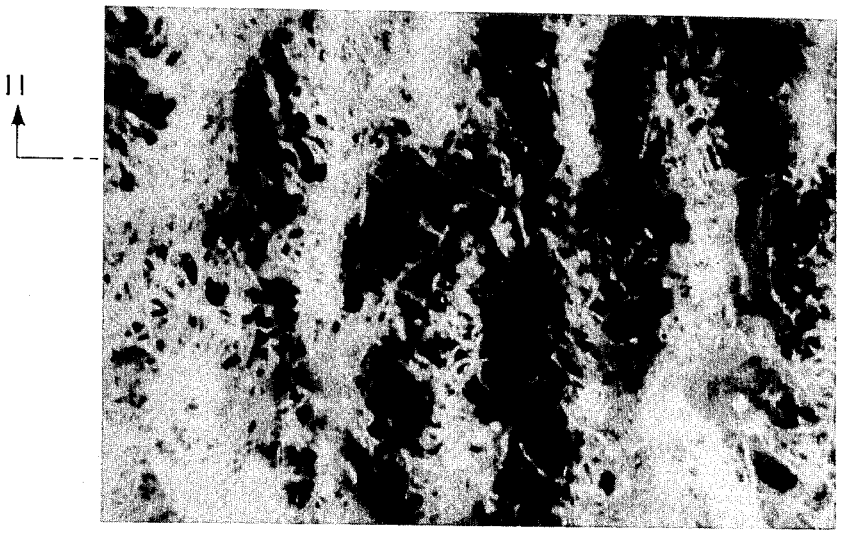
FIG. 10 is a photographic plan view enlarged about 20 times actual size of the fabric side of another embodiment of a layered, creped paper sheet of the present invention produced generally in accordance with the process illustrated in FIG. 1, said sheet being formed from a slurry of softwood fibers on its wire side and a slurry of hardwood fibers on its fabric side, the total fiber content of said sheet being approximately 50 percent softwood and 50 percent hardwood fibers.
Figure 11:
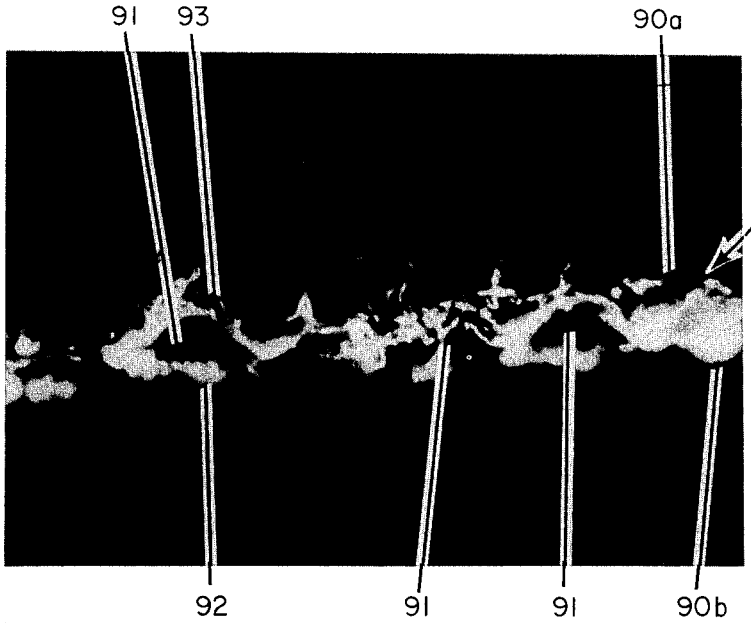
FIG. 11 is an enlarged photographic sectional view of the layered, creped paper sheet shown in FIG. 10 taken looking the cross-machine direction along section line 11—11 in FIG. 10.

FIG. 10 is a photographic plan view enlarged about 20 times actual size of the fabric side 90*a* of a layered creped paper sheet 90 produced generally in accordance with the process illustrated in FIG. 1, said sheet being formed from a slurry of softwood fibers 92 on its wire side 90*b* and a slurry of hardwood fibers 93 on its fabric side 90*a*, the total fiber content of said sheet being approximately 50 percent softwood and 50 percent hardwood fibers. Although the basis weight and processing conditions utilized were essentially the same as those of the sheets shown in FIGS. 4 – 9, a coaser mesh 18 × 16 semi-twill drying/imprinting fabric prepared as described in the aforementioned patent application of Peter G. Ayers was utilized. The finally dried sheet was creped to a level of approximately 20 percent. FIG. 11 clearly illustrates the discrete, totally enclosed pillow structures 91 characteristic of a preferred embodiment of the present invention. The discrete, hollowed-out pillow structures 91 are formed between the long-fibered strata 92 on the wire side 90*b* of the sheet which remains substantially planar and continuous and the short-fibered strata 93 on the fabric side of the sheet which is partially displaced in a plane perpendicular to the sheet in small discrete deflected areas corresponding to the mesh opening of the drying-/imprinting fabric. The increased caliper and lower density of the layered paper sheet 90 shown in FIGS. 10 and 11 are readily apparent when compared to the non-layered prior art sheet 60 shown in FIGS. 4 and 5. A comparison of FIGS. 4 and 10 reveals that the knuckle impressions on the fabric side of the layered sheet 90 are more difficult to discern than on the non-layered prior art sheet 60 due to the reduced overall density of the layered structure. The reorientation of the fibers in the short-fibered strata 93 of the layered web 90 is also highly apparent in FIG. 11. In this regard, it should be noted that the density of the shortfibered strata 93 is lower than that of the long-fibered strata 92 of the layered sheet, thus creating a favorable capillary size gradient between the fabric side of th sheet 90*a* and the wire side of the sheet 90*b*.

Figure 14:
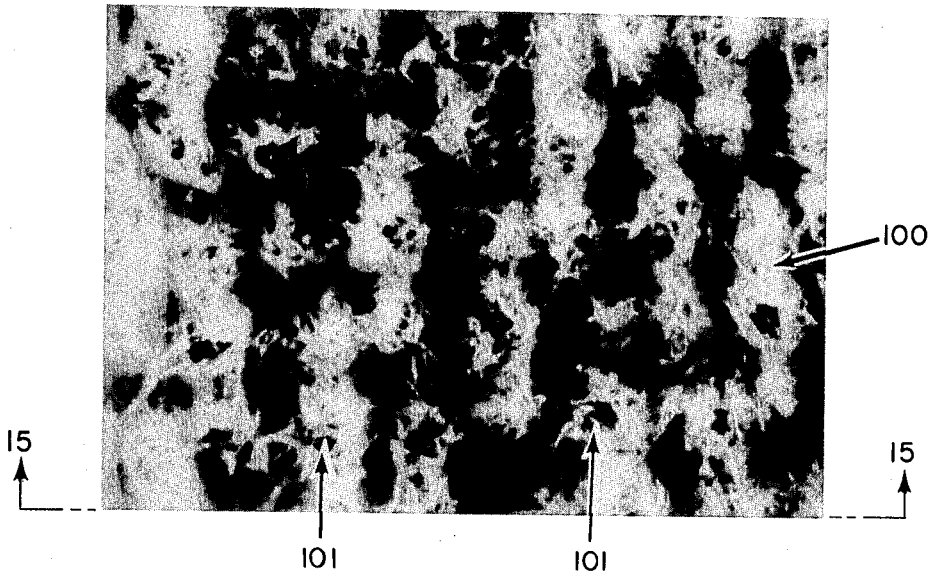
FIG. 14 is a photographic plan view enlarged about 20 times actual size of the fabric side of a layered paper web of the type shown in FIG. 12, said web having been compacted between the knuckles of a drying/imprinting fabric and a dryer drum, finally dried and creped.

FIG. 14 is a plan view photograph enlaged about the same extent as FIGS. 10 and 12 of the fabric side 100*a* of a layered, creped paper web 100 of the type generally shown in FIGS. 12 and 13 after compaction between the fabric knuckles and the dryer drum, final drying and creping thereof generally in accordance with the process illustrated in FIG. 1. The finished layered sheet 100 illustrated in FIGS. 14 and 15 contains approximately 20 percent crepe. The layered sheet 100 is generally similar to the layered sheet 90 illustrated in FIGS. 10 and 11, but the totally enclosed pillow-like structures 91 shown in FIGS. 10 and 11 have burst to form volcano-like cone structures 101 on the fabric side 100*a* of the sheet. It should be noted, however, that the long-fibered strata 102 of the sheet shown in FIGS. 14 and 15 remains substantially planar and continuous. Thus the embodiment of applicants' invention shown in FIGS. 14 and 15 is simply a variant of the embodiment shown in FIGS. 10 and 11, wherein the shortfibered strata 103 has undergone more extensive reorientation and greater penetration of the mesh openings of the drying/imprinting fabric.

Figure 15:
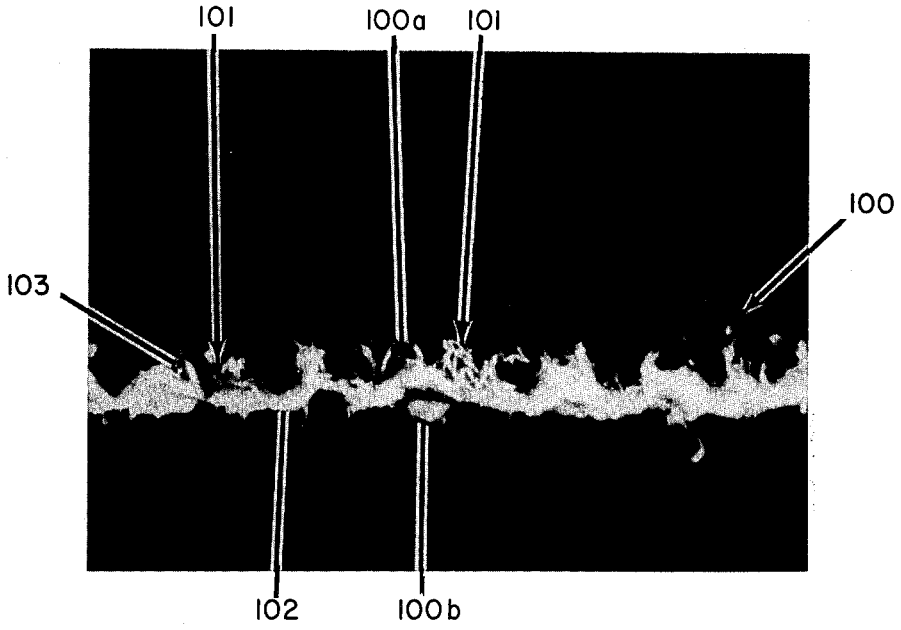
FIG. 15 is an enlarged sectional view of the creped paper sheet shown in FIG. 14 taken looking in the cross-machine direction along section line 15—15 in FIG. 14.

The formation of pillow-like structures 91 as shown in FIG. 11 and/or volcano-like cone structures 101 as shown in FIGS. 13, 15, and 16 in a long-fibered/short-fibered embodiment of applicants' invention such as is generally disclosed in FIG. 3 is primarily a function of the diagonal free span/fiber length relationship, the fiber consistency of the composite web when subjected to fluid pressure on the drying/imprinting fabric and the degree of fluid-pressure applied to the moist paper web. Applicants have further observed that it is not uncommon in layered sheets of the present invention for both the pillow-like structures 91 shown in FIG. 11 and the volcano-like cone structures 101 shown in FIG. 15 to be present in a single sheet.

Because the benefits of improved bulk and caliper derived from layering papermaking fibers in accordance with the present invention depend primarily upon the interaction of the fiber strata on the fabric side of the web and the foraminous drying/imprinting fabric on which the web is subjected to fluid pressure and on which it is thermally predried, any number of prior art forming devices can be utilized to initially form the stratified web.

It should also be noted that the present invention may be practiced with equal facility by utilizing either a single, internally-divided headbox or two separate headboxes and forming the multi-layered paper web directly on the drying/imprinting fabric, as suggested in FIG. 2 of U.S. Pat. No. 3,301,746. Since this latter process does not involve transfer of the web from a fine mesh Fourdrinier forming wire to a coarser mesh drying/imprinting fabric, as illustrated in FIG. 1, fluid pressure, preferably in the form of vacuum, is applied directly thereto prior to thermal predrying of the web. With the above noted exception, this variant is in all other respects identical to the processes described in connection with FIG. 1.

The present invention is most preferably practiced on paper sheets having a dry, uncreped basis weight between about 5 and about 40, and most preferably between about 7 and about 25 pounds per 3,000 square feet, depending upon the desired product weight and the product's intended use. The range of bulk densities associated with the 5 to 40 pound basis weight range is typically between about 0.020 and about 0.200 grams per cubic centimeter while the range of bulk densities associated with the 7 to 25 pound basis weight range is typically between about 0.025 and about 0.130 grams per cubic centimeter, said bulk densities being measured in the uncalendered state under a load of 80 grams per square inch. In general, the bulk density is, at least to a degree, proportional to the basis weight of the paper sheet. That is, bulk density tends to increase with an increase in basis weight, but not necessarily as a linear function.

The stretch properties of finished sheets of the present invention may be varied as desired, depending upon their intended use, by proper selection of the drying/imprinting fabric and by varying the amount of mechanical creping or micro-creping imparted to the sheets.

Since the increase in bulk and caliper of long-fibered/short-fibered stratified paper sheets of the present invention are influenced to a large extent by the contribution of the short-fibered strata of the web, applicants have found that in order to realize the maximum increase in bulk and caliper and consequently the maximum decrease in overall density, the short-fibered strata of the composite web should preferably constitute at least about 20 percent of the web's total bone dry weight, i.e., the weight of the web at 100 percent fiber consistency, and is most preferably between about 40 percent and about 60 percent of the web's total bone dry weight, particularly when dealing with webs at the lower end of the basis weight spectrum. Applicants have further learned that when the short-fibered strata comprises more than about 80 percent of the web's total bone dry weight, the overall tensile strength of the resultant paper structure decreases. Thus, in a most preferred embodiment of the present invention, the short-fibered strata comprises between about 20 percent and about 80 percent, and most preferably between about 40 percent and about 60 percent, of the web's total bone dry weight.

Contamination of the long-fibered strata of the composite web by short papermaking fibers has no apparent negative effects on the finished sheets, at least until the concentration of short fibers in the long-fibered strata becomes so great as to cause tensile strength degradation. Applicants have learned, however, that the reverse is not true. Due apparently to the lower mobility of the longer papermaking fibers and their increased tendency to bridge across intersecting and adjacent filaments of the drying/imprinting fabric and thereby reduce the degree of fiber reorientation and penetration of the fabric mesh openings, applicants have found it desirable, in a most preferred embodiment of the present invention, to maintain a degree of separation between the short-fibered and long-fibered layers such that not more than about 30 percent, and most preferably not more than about 15 percent, of the long papermaking fibers are present in the strata containing primarily short papermaking fibers. As the degree of cross-contamination of the short-fibered strata by long fibers increases beyond this level, the desirable improvements in bulk and caliper which are characteristic of long-fibered/short-fibered stratified paper sheets of the present invention become somewhat less pronounced.

The inventive concept disclosed herein may, if desired, be extended to low-density, multi-layered paper structures comprised, for example, of a long-fibered layer located intermediate a pair of short-fibered layers to provide improved tactile impression and surface dryness on both surfaces of the sheet.

Figure 17:
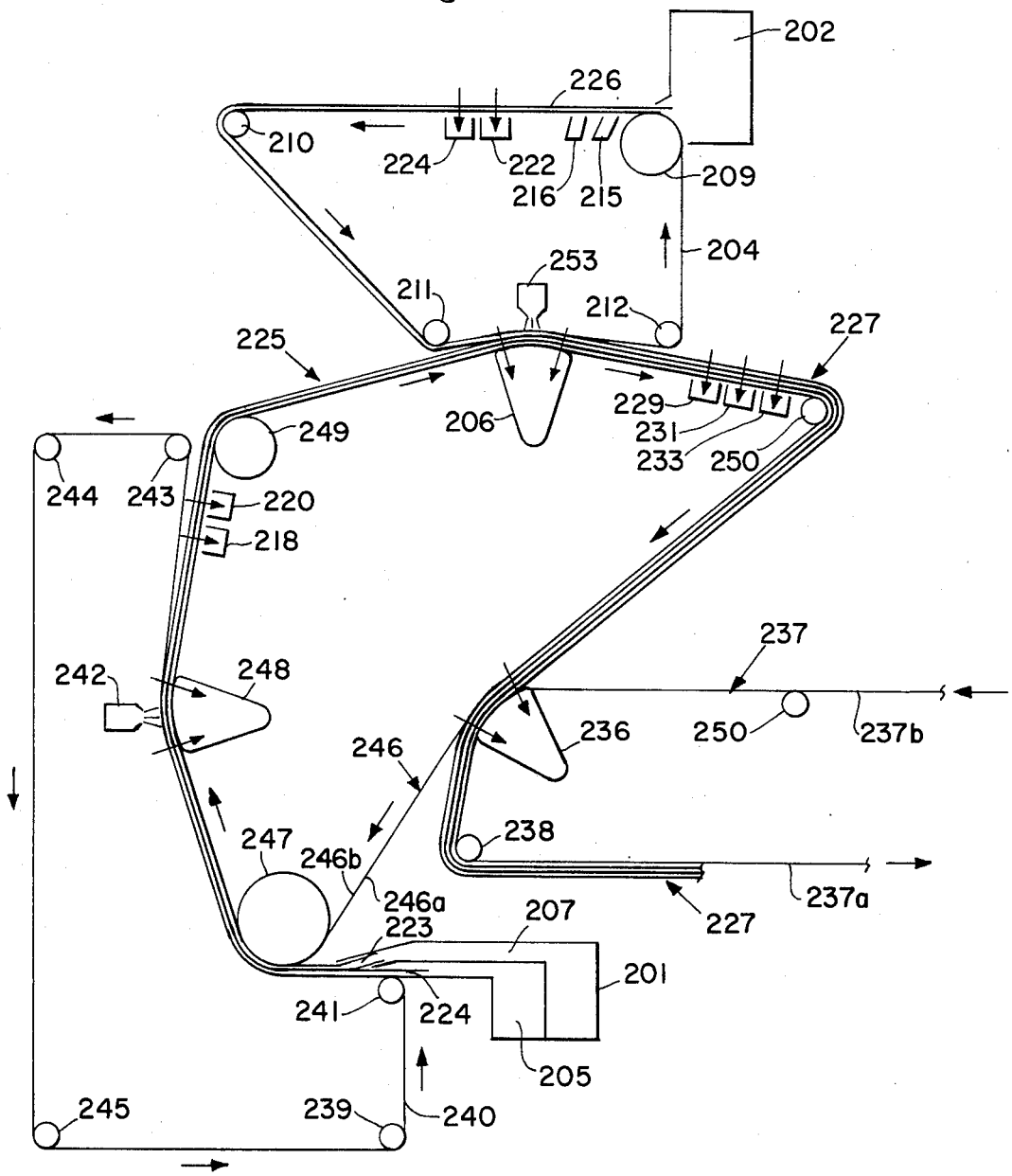
FIG. 17 is a fragmentary schematic illustration of a preferred embodiment of a papermaking machine suitable for producing a low-density, three-layered fibrous web of the present invention.

FIG. 17 is a fragmentary schematic illustration of one embodiment of a process for forming such a three-layered web. An internally divided twin-wire headbox 201 is supplied from separate fibrous slurries so that the uppermost portion of the headbox 207 contains primarily short papermaking fibers while the lowermost portion 205 of the headbox contains primarily long papermaking fibers. A stratified slurry is laid down in the nip formed between a fine mesh Fourdrinier wire 240 operating about rolls 239, 241, 243, 244 and 245 and a coarser mesh imprinting fabric 246 of the type generally described herein operating about rolls 247, 249 and 250. The short-fibered strata 223 and the long-fibered strata 224 coalesce sufficiently at their interface to form a unitary web 225 which is stratified with respect to fiber type. The stratified web 225 is caused to remain in contact with the web supporting surface 246*a* of the imprinting fabric 246 due to the application of fluid pressure to the web at the point of separation between the fine mesh Fourdrinier wire 240 and the coarser mesh imprinting fabric 246. This is preferably accomplished by means of a vacuum pick-up shoe 248 which contacts the undersurface 246*b* of the imprinting fabric. If desired, an optional slotted stream or air nozzle 242 may also be provided. Since the stratified web 225 is at relatively low fiber consistency at this point, the application of fluid pressure to the web, as described above, causes fiber reorientation and fiber penetration into the fabric mesh openings in the short-fibered strata 223 of the web.

If desired, the fiber consistency of the stratified web 225 may be further increased by means of vacuum boxes 218 and 220 to approximate that of the hardwood strata 226 at the point of transfer. The hardwood strata 226 is preferably formed by means of a secondary headbox 202, a fine mesh Fourdrinier wire 204, forming boards 215 and 216 and vacuum boxes 222 and 224 of the type generally described in connection with FIG. 1. The hardwood strata 226 is transferred from the fine mesh Fourdrinier wire 204 to the long-fibered strata 224 of the stratified web 225 to form a three-layered web 227 in essentially the same manner shown in FIG. 1. A vacuum transfer box 206 is preferably employed in contact with the undersurface 246*b* of the imprinting fabric to effect the transfer. If desired, an optional slotted steam or air nozzle 253 may also be provided.

Following transfer, the fiber consistency of the three-layered stratified web 227 is preferably increased to the upper end of the preferred range, i.e., most preferably to a level between about 20 and 25 percent, by means of vacuum boxes 229, 231 and 233. This is generally desirable to minimize disturbance of the deflected areas in the short-fibered strata 223 of the layered web during transfer of the web to the drying/imprinting fabric 237. In a most preferred embodiment of the present invention, the drying/imprinting fabric 237 is substantially identical in construction to the imprinting fabric 246. As is shown in FIG. 17, transfer of the three-layered web from the imprinting fabric 246 to the drying/imprinting fabric 237 is most preferably effected by means of a vacuum pickup shoe 236 which contacts the undersurface 237*b* of the drying/imprinting fabric 237. Since steam jets, air jets, etc., tend to disturb the deflected area in the hardwood strata 223 of the web, it is preferable not to utilize such transfer aids at this particular point.

Following transfer of the three-layered stratified web 227 to the web supporting surface 237*a* of the drying/imprinting fabric, the web may be thermally predried and finished in the same manner as the two-layered web described in connection with FIG. 1.

In order to maximize bulk and caliper improvements in a three-layered paper sheet, such as that shown in FIG. 17, it is preferable to completely dry the web on the drying/imprinting fabric 237 without compacting the web between the fabric knuckles and a non-yielding surface after thermal predrying.

The three-layered embodiment described above is most preferably practiced on paper sheets having a dry, uncreped basis weight between about 8 and about 40 pounds per 3,000 square feet, depending upon the desired product weight and the product's intended use. Such three-layered paper sheets typically exhibit bulk densities between about 0.020 and about 0.200 grams per cubic centimeter.

The present invention has extremely broad application in producing unitary paper sheets having similar or dissimilar surface characteristics on opposite sides thereof, in combining extremely low-density and acceptable tensile strength in a single paper structure, etc. In general, it gives the papermaker greater freedom to custom tailor a combination of desired, but previously incompatible sheet characteristics into a single, unitary paper structure.

Although the foregoing description has been specifically directed toward the utilization of natural papermaking fibers, it will be readily appreciated by those skilled in the art that the present invention may likewise be practiced to advantage in layering man-made papermaking fibers or even combinations of natural and man-made papermaking fibers to produce finished sheets having extremely high-bulk and low density, as well as other particularly desired properties.

The examples hereinafter set forth serve to illustrate the dramatic increase in bulk and reduction in density without sacrifice in overall tensile strength of layered paper sheets produced in accordance with the present invention in comparison to a non-layered prior art paper sheet produced in a similar manner from a single slurry comprised of a homogenous mixture of similar papermaking fibers. Accordingly, the examples are intended to be illustrative and not limiting, and the scope of the invention is only to be construed by the scope of the appended claims.

Each of the following examples was produced generally in accordance with the process illustrated in FIG. 1. All examples were subjected to fluid pressure, thermally predried, and subjected to compaction between the fabric knuckles and a dryer drum on a 26 × 22 polyester semi-twill imprinting fabric having a common warp and woof monofilament diameter of approximately 0.022 inches and a measured diagonal free span of approximately 0.024 inches, said fabric having been treated generally in accordance with the teachings of the aforementioned patent application of Peter G. Ayers. The knuckle imprint area of the fabric comprised approximately 39.1 percent of the web's surface. The total fiber content of each sheet was comprised of approximately 50 percent refined softwood pulp fibers having an average length of about 0.097 inches and 50 percent unrefined hardwood pulp fibers having an average length of about 0.035 inches. Each of the paper webs supported on the drying/imprinting fabric was sujected to compaction by the fabric knuckles by means of a pressure roll operating against a Yankee dryer drum at a pressure of approximately 300 pounds per lineal inch. Each of the sheets was adhered to the surface of a Yankee dryer drum generally in accordance with the teachings of the aforementioned patent application of Gregory A. Bates, and the finally dried sheets were removed from the surface of the dryer drum by means of a doctor blade having a 30° bevel to produce finished sheets containing approximately 20 percent crepe. The creped basis weights of the examples were, to the extent feasible, held constant, the actual values ranging from approximately 14.3 to approximately 14.7 pounds per 3,000 square feet.

EXAMPLE I

A non-layered prior art paper sheet was produced generally in accordance with the teachings of U.S. Pat. No. 3,301,746. The fibrous slurry was comprised of homogeneously mixed softwood and hardwood fibers, the softwood fibers having received 0.48 horsepower-days per ton refining. The homogenously mixed slurry was laid down on a fine mesh Fourdrinier wire to form a unitary, non-layered web. The fiber consistency of the web at the point of transfer from the Fourdrinier wire to the drying/imprinting fabric was approximately 9.2 percent. A pickup shoe vacuum of approximately 9.6 inches of mercury was applied to the moist paper web to effect transfer to the drying/imprinting fabric. The web was thermally predried on the fabric to a fiber consistency of approximately 97.1 percent prior to knuckle compaction thereof upon transfer to the Yankee dryer. The properties exhibited by the resulting paper sheet are set forth in Tables I and II.

EXAMPLE II

A two-layered paper sheet was produced in accordance with the process illustrated and described in connection with FIG. 1. A first fibrous slurry comprised of homogeneously mixed softwood pulp and hardwood pulp fibers, the softwood fibers having received 0.56 horsepower-days per ton refining, was laid down on a fine mesh Fourdrinier wire to form a first fibrous web. A second fibrous slurry of identical composition was laid down from a second headbox onto a second fine mesh Fourdrinier wire to form a second fibrous web. The second fibrous web was thereafter combined with said first fibrous web while both webs were at relatively low fiber consistency to form a two-layered moist paper web in accordance with the process illustrated in FIG. 1. The fiber consistency of the two-layered web at the point of transfer from the Fourdrinier wire to the drying/imprinting fabric was approximately 9.9 percent. A pickup shoe vacuum of approximately of 9.7 inches of mercury was applied to the moist paper web to effect transfer to the drying/imprinting fabric. The web was thermally predried on the fabric to a fiber consistency of approximately 94.9 percent prior to knuckle compaction thereof upon transfer to the Yankee dryer. The properties exhibited by the resulting paper sheet are set forth in Tables I and II.

EXAMPLE III

A two-layered paper sheet was produced in accordance with the process illustrated and described in connection with FIG. 1. A first fibrous slurry comprised of hardwood pulp fibers was laid down on a fine mesh Fourdrinier wire to form a first fibrous web. A second fibrous slurry comprised of softwood pulp fibers, said softwood fibers having received 0.44 horsepower-days per ton refining, was laid down from a second headbox onto a second fine mesh Fourdrinier wire to form a second fibrous web. The second fibrous web was thereafter combined with said first fibrous web while both webs were at relatively low fiber consistency to form a two-layered moist paper web in accordance with the process illustrated in FIG. 1. The fiber consistency of the two-layered web at the point of transfer from the Fourdrinier wire to the drying/imprinting fabric was approximately 9.6 percent. A pickup shoe vacuum of approximately 9.5 inches of mercury was applied to the moist paper web to effect transfer to the drying/imprinting fabric. The web was transferred to the fabric so that the softwood strata was placed in contact with the web supporting surface of the fabric. The web was thermally predried on the fabric to a fiber consistency of approximately 94.2 percent prior to knuckle compaction thereof upon transfer to the Yankee dryer. The properties exhibited by the resulting paper sheet are set forth in Tables I and II.

EXAMPLE IV

A two-layered paper sheet was produced in accordance with the process illustrated and described in connection with FIG. 1. A first fibrous slurry comprised of softwood fibers, said softwood pulp fibers having received 0.48 horsepower-days per ton refining, was laid down on a fine mesh Fourdrinier wire to form a first fibrous web. A second fibrous slurry comprised of hardwood pulp fibers was laid down from a second headbox onto a second fine mesh Fourdrinier wire to form a second fibrous web. The second fibrous web was thereafter combined with said first fibrous web while both webs were at relatively low fiber consistency to form a two-layered, stratified moist paper web in accordance with the process illustrated in FIG. 1. The fiber consistency of the two-layered web at the point of transfer from the Fourdrinier wire to the drying/imprinting fabric was approximately 8.9 percent. A pickup shoe vacuum of approximately 10.0 inches of mercury was applied to the moist paper web to effect transfer to the drying/imprinting fabric. The web was transferred to the drying/imprinting fabric so that its hardwood strata was placed in contact with the web supporting surface of the fabric. The web was thermally predried on the fabric to a fiber consistency of approximately 89.4 percent prior to knuckle compaction thereof upon transfer to the Yankee dryer. The properties exhibited by the resulting paper sheet are set forth in Tables I and II.

EXAMPLE V

A two-layered paper sheet was produced in a manner similar to that of Example IV, but the processing conditions were varied as follows: (1) the softwood pulp fibers received 0.40 horsepower-days per ton refining; (2) the fiber consistency of the two-layered web at the point of transfer from the Fourdrinier wire to the drying/imprinting fabric was approximately 9.6 percent; (3) a pickup shoe vacuum of approximately 5.0 inches of mercury was applied to the moist paper web to effect transfer to the drying/imprinting fabric; and (4) the web was thermally predried on the fabric to a fiber consistency of approximately 85.0 percent prior to knuckle compaction thereof upon transfer to the Yankee dryer. Properties exhibited by the resulting paper sheet are set forth in Tables I and II.

EXAMPLE VI

A two-layered paper sheet was produced in a manner similar to that of Example IV, but the processing conditions were varied as follows: (1) the softwood pulp fibers received 0.40 horsepower-days per ton refining; (2) the fiber consistency of the two-layered web at the point of transfer from the Fourdrinier wire to the drying/imprinting fabric was approximately 16.5 percent; (3) a pickup shoe vacuum of approximately 9.5 inches of mercury was applied to the moist paper web to effect transfer to the drying/imprinting fabric; and (4) the web was thermally predried on the fabric to a fiber consistency of approximately 84.5 percent prior to knuckle compaction thereof upon transfer to the Yankee dryer. Properties exhibited by the resulting paper sheet are set forth in Tables I and II.

The comparative tests conducted on the various examples described in Tables I and II were carried out as follows:

Dry Caliper

This was obtained on a Model 549M motorized micrometer such as is available from Testing Machines, Inc. of Amityville, Long Island, New York. Product samples were subjected to a loading of 80 gm. per sq. in. under a 2 in. diameter anvil. The micrometer was zeroed to assure that no foreign matter was present beneath the anvil prior to inserting the samples for measurement and calibrated to assure proper readings. Measurements were read directly from the dial on the micrometer and are expressed in mils.

Calculated Density

The density of each sample sheet was calculated by dividing the basis weight of the sample sheet by the caliper of the sample sheet, as measured at 80 gm. per sq. in.

Dry Tensile Strength

This was obtained on a Thwing-Albert Model QC tensile tester such as is available from the Thwing-Albert Instrument Company of Philadelphia, Pennsylvania. Product samples measuring 1 in. by 6 in. were cut in both the machine and cross-machine directions. Four sample strips were superimposed on one another and placed in the jaws of the tester, set at a 2 in. gauge length. The crosshead speed during the test was 4 in. per minute. Readings were taken directly from a digital readout on the tester at the point of rupture and divided by four to obtain the tensile strength of an individual sample. Results are expressed in grams/in.

Stretch

Stretch is the percent machine direction and cross-machine direction elongation of the sheet, as measured at rupture, and is read directly from a second digital readout on the Thwing-Albert tensile tester. Stretch readings were taken concurrently with tensile strength readings.

Machine Direction Tearing Resistance

This was obtained on a 200-gram capacity Elmendorf Model 60-5-2 tearing tester such as is available from the Thwing-Albert Instrument Company of Philadelphia, Pennsylvania. The test is designed to measure the tearing resistance of sheets in which a tear has been started. Product samples were cut to a size of 2½ in. by 3 in., with the 2½ in. dimension aligned parallel to the machine direction of the samples. Eight product samples were stacked one upon the other and clamped in the jaws of the tester so as to align the direction of tear parallel to the 2½ in. dimension. A ½ in. long cut was then made at the lowermost edge of the stack of samples in a direction parallel to the direction of tear. A model 65-1 digital read-out unit, also available from the Thwing-Albert Instrument Company, was zeroed and calibrated using an Elmendorf No. 60 calibration weight prior to initiating the test. Readings were taken directly from the digital read-out unit and inserted into the following equation:

$$\text{Tearing Resistance} = \left[\frac{\text{Tear Tester capacity (gm.)} \times \text{Reading from Digital Read-out Unit (\%)}}{\text{Number of plies of Product Tested}}\right] \times \frac{1}{100}$$

Results are expressed in terms of grams/ply of product.

Handle-O-Meter

This was obtained on a Catalog No. 211-3 Handle-O-Meter such as is available from the Thwing-Albert Instrument Company of Philadelphia, Pennsylvania. Handle-O-Meter values give an indication of sheet stiffness and sliding friction which are in turn related to handle, softness and drape. Lower Handle-O-Meter values are indicative of less stiffness, and hence point toward better handle, softness, and drape. Product samples were cut to a size of 4½ in. by 4½ in., and two samples placed adjacent one another across a slot having a width of 0.25 in. for each test. Handle-O-Meter values in the machine direction were obtained by aligning the machine direction of the product samples parallel to the Handle-O-Meter blade, while Handle-O-Meter values in the cross-machine direction were obtained by aligning the cross-machine direction of the product samples parallel to the Handle-O-Meter blade. Handle-O-Meter results are expressed in grams.

Flexural Rigidity and Bending Modulus

In order to quantify sheet properties relating to tactile impression and drape, resort was had to the principles of textile testing. Fabric handle, as its name implies, is concerned with the feel or tactile impression of the material and so depends on the sense of touch. When the handle of a fabric is judged, the sensations of stiffness or limpness, hardness or softness, and roughness or smoothness are all made use of. Drape has a rather different meaning and very broadly is the ability of a fabric to assume a graceful appearance in use. Experience in the textile industry has shown that fabric stiffness is a key factor in the study of handle and drape.

One instrument devised by the textile industry to measure stiffness is the Shirley Stiffness Tester. In order to compare the drape and surface feel properties of the paper samples described in Examples I – VI above, a Shirley Stiffness Tester was constructed to determine the "bending length" of the paper samples, and hence to calculate values for "flexural rigidity" and "bending modulus".

The Shirley Stiffness Tester is described in ASTM Standard Method No. 1388. The horizontal platform of the instrument is supported by two side pieces made of plastic. The side pieces have engraved on them index lines at the standard angle of deflection of 41½°. Attached to the instrument is a mirror which enables the operator to view both index lines from a convenient position. The scale of the instrument is graduated in centimeters. The scale may be used as a template for cutting the specimens to size.

To carry out a test, a rectangular strip of paper, 6 inches by 1 inch, is cut to the same size as the scale and then both scale and specimen are transferred to the platform with the specimen underneath. Both are slowly pushed forward. The strip of paper will commence to droop over the edge of the platform as the scale and specimen are advanced. Movement of the scale and the specimen is continued until the tip of the specimen viewed in the mirror cuts both of the index lines. The amount of overhang, "  ", can immediately be read off from the scale mark opposite a zero line engraved on the side of the platform.

Due to the fact that paper assumes a permanent set after being subjected to such a stiffness test, four individual specimens were utilized to test the stiffness of the paper along a given axis, and an average value for the particular axis was then calculated. Samples were cut in both the machine and cross-machine directions. From the data collected in both the machine and cross-machine directions, an average overhang value, "  ", was calculated for the particular paper sample.

The bending length, "$c$", for purposes of these tests, shall be defined as the length of paper that will bend under its own weight to a definite extent. It is a measure of the stiffness that determines draping quality. The calculation is as follows:

"c" = "  " cm. $x$ f($\theta$) where $f(\theta) = [\cos \frac{1}{2}\theta \div 8 \tan \theta]^{1/3}$, and "  " = the average overhang value of the particular paper sample as determined above.

In the case of the Shirley Stiffness Tester, the angle $\theta = 41\frac{1}{2}°$, at which angle $f(\theta)$ or $f(41\frac{1}{2}°) = 0.5$. Therefore, the above calculation simplifies to:

"$c$" = "  " × (0.5) cm.

Flexural rigidity, "G", is a measure of stiffness associated with handle. The calculation of flexural rigidity, "G", in the present instance is as follows:

"G" = 0.1629 × (basis weight of the particular paper sample in pounds per 3,000 sq. ft.) × "c"$^3$mg.-cm., where "c" = the bending length of the particular paper sample as determined above, expressed in cm.

The bending modulus, "$q$", as reported in the examples, is independent of the dimensions of the strip tested and may be regarded as the "intrinsic stiffness" of the material. Therefore, this value may be used to compare the stiffness of materials having different thicknesses. For its calculation, the thickness or caliper of the paper sample was measured at a pressure of 80 grams per square inch rather than 1 pound per square inch as suggested by *ASTM Standard Method No.* 1388. The 80 gm. caliper pressure was utilized to minimize any tendency toward crushing the sheet and thereby obscuring the differences between the various examples.

The bending modulus, "$q$", is then given by:

"$q$" = 732 × "G" ÷ "$g$"$^3$kg./sq.cm., where "G" is the flexural rigidity of the particular paper sample as determined above, expressed in mg.-cm., and "$g$" is the thickness or caliper of the particular paper sample, expressed in mils, when subjected to a pressure of 80 gm. per square inch.

The results of tests performed on sample paper sheets produced during the runs described above are reported in the examples hereinbelow in terms of flexural rigidity, "G", and bending modulus, "$q$", which have relevance with respect to both drape and tactile impression. Lower flexural rigidity and lower bending modulus values are generally indicative of improved drape and tactile impression.

Compressive Work Value

The CWV numbers reported in the tables of examples hereinbelow define the compressive deformation characteristics (sponginess is part of a total impression of softness to a person who handles the paper) of a paper sheet loaded on its opposing flat surfaces. The significance of the CWV number is better understood by the realization that the CWV number represents the total work required to compress the surfaces of a single flat paper sheet inwardly toward each other to a unit load of 125 grams per square inch. In accomplishing the foregoing compression test, the thickness of the paper sheet is decreased, and work is done. This work, or expended energy, is similar to the work done by a person who pinches the flat surfaces of a flat sheet of paper between his thumb and forefinger to gain an impression of its softness. Applicants have found that CWV numbers correlate well with the softness impression obtained by a person who handles a paper sheet.

An Instron Tester Model No. TM was used to measure the CWV numbers by placing a single, 4 square inch paper sheet between compression plates. The sample was then loaded on its flat opposing surfaces at a rate of 0.10 inch of compression deformation per minute until the loading per square inch reached 125 grams.

The Instron Tester is equipped with a recording unit which integrates the compression movement of the sheet surfaces and the instantaneous loading to give the total work in inch-grams required to reach the 125 grams per square inch loading. This work, expressed as inch-grams per 4 square inches of sheet area, is the CWV number used herein. A higher CWV number is generally indicative of a softer sheet.

Compressive Modulus

The compressive modulus, as reported in the Examples below, is generally similar to the modulus of elasticity described at pages 7-05 and 7-06 of *Kent's Mechanical Engineer's Handbook, Eleventh Edition*, said publication being hereby incorporated herein by reference. The compressive modulus may be regarded as the "intrinsic resistance to compression" of the material at a particular point on the stress-strain diagram generated during the test procedure for establishing CWV values, as described above.

According to the aforementioned publication, the modulus of elasticity, or compressive modulus "E", is given by the equation:

$$E = \frac{Pl}{Ae}$$

where "P" is the applied force, "  " is the length of the sample being tested, "A" is the cross-sectional area of the sample being tested, and "*e*" is the total resulting deformation of the sample.

In determining the compressive modulus for paper samples, the proportional limit of the material being tested is extremely low. Therefore, the above equation was modified as follows:

$$E = \frac{(\Delta P)l}{A(\Delta e)}$$

where "(ΔP)" is the differential force determined by drawing a line tangent to the stress-strain diagram at a predetermined applied load value (in this case 400 grams) and extending the tangent line a predetermined distance on each side of the applied load value (in this case from 300 to 500 grams) to yield a differential force, "(ΔP)" (in this case 200 grams);

"  " is the caliper of the paper sample being tested, as measured at the applied load value (in this case 400 grams);

"A" is the surface area of the paper sample being tested (in this case 4 sq. in.); and "(Δ*e*)" is the differential deformation of the sample being tested, as determined by the end points of the aforementioned tangent line (i.e., the deformation as measured at 300 grams applied load less the deformation as measured at 500 grams applied load).

Lower compressive modulus values are generally desirable in tissues and sanitary products in that they are indicative of reduced resistance to collapse under loads normally applied to such structures.

Absorptive Capacity

One facet of a paper sheet's overall absorbency is its absorptive capacity for water. This test was utilized to determine the capacity of each sample sheet to absorb water at a specified flow rate in a specified time. Product samples were cut to a size of 4 in. by 4 in., stacked 8-high, and placed in a polyurethane holder on an inclined plane of an absorptive capacity tester. The weights of both the sample and of the polyurethane holder were determined prior to wetting of the sample. Samples were placed in the polyurethane holder such that their cross-machine direction was aligned parallel to the inclined plane. Water was introduced at the uppermost end of the inclined plane at a controlled rate of 500 ml./minute for a period of one minute. The saturated sample was allowed to remain on the inclined polyurethane holder for an additional 45 seconds after the water had been turned off during which time excess water was removed from the polyurethane holder, care being taken not to contact the saturated sample. The weight of the polyurethane holder and the saturated sample was then measured. The amount of water absorbed by the sample was determined by subtracting the dry weight of the polyurethane holder and sample from the wet weight of the polyurethane holder and sample. Since the dry weight of the sample was also known, the following calculation was performed:

$$\text{Water absorbed Per Unit of Product} = \frac{[\text{Total Quantity of Water absorbed by Known Quantity of Sample (gm.)}]}{[\text{Dry Weight of Known Quantity of Sample (gm.)}]}$$

Results are expressed in terms of grams of water absorbed/gram of sample.

Rate of Absorption

Another facet of a paper sheet's overall absorbency is its rate of water absorption. This test was conducted by measuring the time in seconds required for 0.10 ml. of distilled water to be absorbed by a single 4 in. by 4 in. sheet sample using a Reid style tester such as is described in detail in an article by S. G. Reid entitled "A Method for Measuring the Rate of Absorption of Water by Creped Tissue Paper," which appears at pages T-115 to T-117 of *Pulp and Paper Magazine of Canada, Volume* 68, No. 3, Convention Issue, 1967. Tests were conducted by simultaneously opening the stop-cock located between the calibrated pipette and the capillary tip contacting the sample and starting a timer, observing the water level in the pipette as the water was being absorbed by the sample, and stopping the timer when exactly 0.10 ml. of water had been dispensed from the calibrated pipette. Readings were taken directly from the timer and are expressed in seconds. Lower times are indicative of a higher rate of water absorption.

Each product characteristic compared in Tables I and II by means of the hereinbefore described tests was based upon the average value for all such tests actually conducted on the subject example.

TABLE I

| | Creped Basis Wt. (No./3000 ft²) | Caliper (mils under load of 80 gm/in²) | Calculated density (gm/cc under load of 80 gm/in²) | Dry Tensile MD (gm/in) | Dry Tensile CD (gm/in) | Stretch MD (Percent) | Stretch CD (Percent) | Machine Direction Tearing Resistance (gm/ply) | H-O-M MD (gm) | H-O-M CD (gm) |
|---|---|---|---|---|---|---|---|---|---|---|
| EXAMPLE I | 14.5 | 17.9 | 0.0518 | 319 | 136 | 32.4 | 9.0 | 9 | 31 | 7 |
| EXAMPLE II | 14.5 | 19.6 | 0.0473 | 173 | 85 | 30.8 | 11.7 | 7 | 13 | 6 |
| EXAMPLE III | 14.5 | 20.0 | 0.0464 | 261 | 108 | 35.7 | 9.6 | 10 | 12 | 5 |
| EXAMPLE IV | 14.3 | 20.5 | 0.0446 | 343 | 170 | 35.8 | 10.0 | 10 | 11 | 4 |
| EXAMPLE V | 14.4 | 19.3 | 0.0478 | 331 | 158 | 35.0 | 9.7 | 11 | 13 | 4 |

TABLE I-continued

| | Creped Basis Wt. (No./3000 ft²) | Caliper (mils under load of 80 gm/in²) | Calculated density (gm/cc under load of 80 gm/in²) | Dry Tensile MD (gm/in) | Dry Tensile CD (gm/in) | Stretch MD (Percent) | Stretch CD (Percent) | Machine Direction Tearing Resistance (gm/ply) | H-O-M MD (gm) | H-O-M CD (gm) |
|---|---|---|---|---|---|---|---|---|---|---|
| EXAMPLE VI | 14.7 | 20.4 | 0.0461 | 305 | 163 | 32.9 | 9.2 | 10 | 8 | 4 |

TABLE II

| | Flexural Rigidity (mg/cm) | Bending Modulus (kg/cm²) | Compressive Work Value (in-gm/4 sq.in of sheet area) | Compressive Modulus (gm/in²) | Absorptive Capacity (gm of water/gm of fiber) | Rate of Absorption (time in seconds to absorb 0.10 ml. of distilled water) |
|---|---|---|---|---|---|---|
| EXAMPLE I | 27.9 | 3.81 | 0.966 | 991 | 15.7 | 12.9 |
| EXAMPLE II | 15.6 | 1.45 | 1.446 | 653 | 17.5 | 8.7 |
| EXAMPLE III | 17.1 | 1.56 | 1.013 | 944 | 17.9 | 15.7 |
| EXAMPLE IV | 18.8 | 1.59 | 1.208 | 817 | 18.9 | 12.7 |
| EXAMPLE V | 18.3 | 1.86 | 1.018 | 837 | 20.1 | 14.0 |
| EXAMPLE VI | 23.2 | 2.00 | 1.068 | 768 | 20.4 | 12.8 |

A comparison of the finished sheet characteristics set forth in Tables I and II clearly demonstrates the increased caliper and decreased density of layered paper sheets of the present invention when compared to a similarly-produced, non-layered prior art sheet of comparable basis weight. This is further reflected in their improved absorptive capacity. As can be seen from Tables I and II, layered paper sheets of the present invention, in general, exhibit overall tensile and stretch characteristics comparable to those of the more dense, non-layered, prior art structure. In addition, such sheets exhibit lower handle-o-meter, flexural rigidity, bending modulus and compressive modulus values as well as higher compressive work values, all of which are generally indicative of improved softness, drape, flexibility and tactile impression.

It is to be understood that the forms of the invention herein illustrated and described are to be taken as preferred embodiments. Various changes or omissions may be made in the manufacturing process and/or the product without departing from the spirit or scope of the invention as described in the appended claims.

Having thus defined and described the invention, what is claimed is:

1. A soft, bulky and absorbent unitary paper sheet having a basis weight of from about 5 to about 40 pounds per 3,000 square feet, as measured in an uncreped state, said sheet being characterized by having a structure which in cross-section comprises at least two superposed stratified fibrous layers in contacting relationship for a major portion of their areas, at least one of said stratified fibrous layers being partially displaced in a plane perpendicular to said sheet in small discrete deflected areas corresponding to the mesh openings in a foraminous fabric and comprising from about 100 to about 3,600 individual deflected areas per square inch, as measured in an uncreped state.

2. The soft, bulky and absorbent paper sheeet of claim 1, wherein said discrete deflected areas are of lower density than the remaining portions of said paper sheet.

3. The soft, bulky and absorbent paper sheet of claim 2, said sheet being further characterized by having an overall bulk density, as measured in an uncalendered state at a loading of 80 grams per square inch, of from about 0.020 to about 0.200 grams per cubic centimeter.

4. The soft, bulky and absorbent paper sheet of claim 1, wherein said superposed stratified fibrous layers are comprised of dissimilar fiber types.

5. The soft, bulky and absorbent paper sheet of claim 4, said sheet comprising two stratified fibrous layers, one of said stratified fibrous layers being partially deflected in a plane perpendicular to the sheet and the other of said stratified fibrous layers being substantially planar and continuous.

6. The soft, bulky and absorbent paper sheet of claim 5, wherein the stratified fibrous layer which is partially deflected in a plane perpendicular to the sheet is comprised primarily of relatively short papermaking fibers having an average length between about 0.01 and about 0.06 inches and the stratified fibrous layer which is substantially planar and continuous is comprised primarily of relatively long papermaking fibers having an average length of at least about 0.08 inches.

7. The soft, bulky and absorbent paper sheet of claim 6, wherein at least a portion of said discrete deflected areas in said short-fibered layer interact with said substantially planar and continuous long-fibered layer to form structures which in cross-section have the appearance of totally-enclosed pillows.

8. The soft, bulky and absorbent paper sheet of claim 6, wherein at least a portion of said discrete deflected areas in said short-fibered layer form structures which in cross-section have the appearance of volcano-like cones.

9. The soft, bulky and absorbent paper sheet of claim 6, wherein said relatively short papermaking fibers are comprised of hardwood pulp and said relatively long papermaking fibers are comprised of softwood pulp.

10. The soft, bulky and absorbent paper sheet of claim 6, wherein the bone dry weight of said stratified fibrous layer comprised primarily of relatively short papermaking fibers comprises between about 20 and about 80 percent of the total bone dry weight of said paper sheet.

11. The soft, bulky and absorbent paper sheet of claim 6, wherein said stratified fibrous layer comprised primarily of relatively short papermaking fibers contains not more than about 30 percent of the relatively long papermaking fibers from which said substantially planar and continuous fibrous layer is comprised.

12. The soft, bulky and absorbent paper sheet of claim 1, wherein said superposed stratified fibrous layers are comprised of similar fiber types.

13. The soft, bulky and absorbent paper sheet of claim 12, wherein each of said superposed stratified fibrous layers is displaced in small discrete deflected areas in a plane perpendicular to said sheet, said discrete deflected areas creating discontinuities extending throughout the entire thickness of said sheet.

14. The soft, bulky and absorbent paper sheet of claim 12, wherein each of said superposed stratified fibrous layers is comprised of a homogeneous mixture of relatively long papermaking fibers having an average length of at least about 0.08 inches and relatively short papermaking fibers having an average length between about 0.01 and about 0.06 inches.

15. The soft, bulky and absorbent paper sheet of claim 12, wherein each of said superposed stratified fibrous layers is comprised primarily of relatively long papermaking fibers having an average length of at least about 0.08 inches.

16. A soft, bulky and absorbent unitary paper sheet having a basis weight from about 7 to about 25 pounds per 3,000 square feet, as measured in an uncreped state, said sheet being characterized by having a structure which in cross-section comprises at least two superposed stratified fibrous layers in contacting relationship for a major portion of their areas, at least one of said stratified fibrous layers being partially displaced in a plane perpendicular to said sheet in a regular pattern of small discrete deflected areas corresponding to the mesh openings in a foraminous fabric and comprising from about 100 to about 3,600 individual deflected areas per square inch, as measured in an uncreped state.

17. The soft, bulky and absorbent paper sheet of claim 16, wherein said discrete deflected areas are of lower density than the remaining portions of said paper sheet.

18. The soft, bulky and absorbent paper sheet of claim 17, said sheet being further characterized by having a bulk density, as measured in an uncalendered state at a loading of 80 grams per square inch, of from about 0.025 to about 0.130 grams per cubic centimeter.

19. The soft, bulky and absorbent paper sheet of claim 17, said sheet comprising two stratified fibrous layers, one of said stratified fibrous layers being partially deflected in a plane perpendicular to the sheet and the other of said stratified fibrous layers being substantially planar and continuous.

20. The soft, bulky and absorbent paper sheet of claim 19, wherein the stratified fibrous layer which is partially deflected in a plane perpendicular to the sheet is comprised primarily of relatively short papermaking fibers having an average length between about 0.01 and about 0.06 inches and the stratified fibrous layer which is substantially planar and continuous is comprised primarily of relatively long papermaking fibers having an average length between about 0.08 and about 0.12 inches.

21. The soft, bulky and absorbent paper sheet of claim 20, wherein at least a portion of said discrete deflected areas in said short-fibered layer interact with said substantially planar and continuous long-fibered layer to form structures which in cross-section have the appearance of totally-enclosed pillows.

22. The soft, bulky and absorbent paper sheet of claim 20, wherein at least a portion of said discrete deflected areas in said short-fibered layer form structures which in cross-section have the appearance of volcano-like cone structures.

23. The soft, bulky and absorbent paper sheet of claim 20, wherein the bone dry weight of said stratified fibrous layer comprised primarily of relatively short hardwood fibers comprises between about 40 and about 60 percent of the total bone dry weight of said paper sheet.

24. The soft, bulky and absorbent paper sheet of claim 20, wherein said stratified fibrous layer comprised primarily of relatively short papermaking fibers contains not more than about 15 percent of the relatively long papermaking fibers from which said substantially planar and continuous fibrous layer is comprised.

25. A soft, bulky and absorbent unitary paper sheet having a basis weight of from about 8 to about 40 pounds per 3,000 square feet, as measured in an uncreped state, said sheet being characterized by having a structure which in cross-section comprises at least three superposed stratified fibrous layers, said outermost stratified layers being in contacting relationship with said central stratified layer for a major portion of their areas, each of said outermost stratified layers being partially displaced in a plane perpendicular to said sheet in small discrete deflected areas corresponding to the mesh openings in a foraminous fabric and comprising from about 100 to about 3,600 deflected areas per square inch, as measured in an uncreped state, said central stratified layer being substantially planar and continuous.

26. The soft, bulky and absorbent paper sheet of claim 25, wherein said discrete deflected areas in said outermost stratified fibrous layers are of lower density than the remaining portions of said paper sheet.

27. The soft, bulky and absorbent paper sheet of claim 26, wherein each of said outermost stratified layers is comprised primarily of relatively short papermaking fibers having an average length between about 0.01 and about 0.06 inches and said central stratified layer is comprised primarily of relatively long papermaking fibers having an average length of at least about 0.08 inches, said sheet being further characterized by improved tactile impression on both surfaces thereof.

28. The soft, bulky and absorbent paper sheet of claim 27, said sheet being further characterized by having a bulk density, as measured in an uncalendered state at a loading of 80 grams per square inch, of from about 0.020 to about 0.200 grams per cubic centimeter.

29. A process for the manufacture of a soft, bulky and absorbent unitary paper sheet having a basis weight between about 5 and about 40 pounds per 3,000 square feet, as measured in an uncreped state, which comprises the steps of:

a. forming a moist paper web comprising at least two superposed stratified fibrous layers in contacting relationship;

b. supporting said moist paper web on a foraminous fabric having between about 100 and about 3,600 mesh openings per square inch;

c. subjecting said moist paper web to a pressure differential while on said fabric while said web is at a fiber consistency between about 5 and about 25 percent, thereby partially displacing at least one of said stratified fibrous layers in a plane perpendicular to said sheet in small discrete deflected areas corresponding to the mesh openings in said fabric; and d. final drying said sheet without disturbing the deflected areas of said one of said stratified layers.

30. The process of claim 29, wherein the step of subjecting said moist paper web to a pressure differential is carried out by applying vacuum to the undersurface of said fabric.

31. The process of claim 29, wherein the step of forming a moist paper web is carried out by combining a first stratified fibrous layer comprised primarily of relatively short papermaking fibers having an average length between about 0.01 and about 0.06 inches with a second stratified fibrous layer comprised primarily of relatively long papermaking fibers having an average length of at least about 0.08 inches while said fibrous layers are at a fiber consistency not greater than about 20 percent.

32. The process of claim 31, wherein said foraminous fabric has a diagonal free span between about 0.005 and about 0.080 inches, and the step of supporting said moist paper web on said foraminous fabric is carried out by placing the surface of said web containing primarily short papermaking fibers in contact with the web supporting surface of said fabric.

33. The process of claim 29, including the steps of thermally predrying said moist paper web to a fiber consistency of at least about 30 percent while on said fabric, and thereafter subjecting discrete portions of said thermally predried web to compaction between the knuckles of said fabric and a non-yielding surface.

34. The process of claim 33, including the steps of adhering said thermally predried paper web to the surface of a dryer drum at discrete locations corresponding to the areas of discrete compaction by the knuckles of said fabric, finally drying said paper web on the surface of said dryer drum, and creping said finally dried paper web during removal from said dryer drum by means of a doctor blade.

35. The process of claim 29, including the steps of finally drying said moist paper web on said fabric and thereafter subjecting said finally dried paper web to mechanical micro-creping upon removal of said web from said fabric.

36. A process for the manufacture of a soft, bulky and absorbent unitary paper sheet having a basis weight between about 7 and about 25 pounds per 3,000 square feet, as measured in an uncreped state, which comprises the steps of:

a. forming a first moist fibrous web on a foraminous support medium;

b. superimposing on said first fibrous web a second moist fibrous web to form a stratified moist paper web;

c. transferring said stratified moist paper web from said foraminous support medium to a foraminous drying/imprinting fabric having between about 100 and about 3,600 mesh openings per square inch and a diagonal free span between about 0.009 and about 0.054 inches by applying fluid pressure to said web while said web is at a fiber consistency between about 5 and about 25 percent, thereby partially displacing said fibrous layer in contact with the web supporting surface of said drying/imprinting fabric in small discrete deflected areas corresponding to the mesh openings in said fabric;

d. thermally predrying said moist paper web to a fiber consistency of at least about 30 percent without disturbing the relationship of said web to said fabric; and e. final drying the paper sheet thus formed.

37. The process of claim 36, including the step of subjecting discrete portions of said thermally predried paper web to compaction between the knuckles of said fabric and a non-yielding surface.

38. The process of claim 37, including the steps of adhering said thermally predried paper web to the surface of a dryer drum in discrete locations corresponding to the areas of discrete compaction by the knuckles of said fabric, finally drying said thermally predried paper web on the surface of said dryer drum, and creping said finally dried paper web during removal from said dryer drum by means of a doctor blade.

39. The process of claim 38, including the step of calendering said finally dried, creped paper sheet to impart uniform caliper thereto.

40. The process of claim 36, including the steps of finally drying said thermally predried paper web on said fabric and thereafter subjecting said finally dried paper web to mechanical micro-creping upon removal from said fabric.

41. The process of claim 40, including the step of calendering said finally dried, mechanically micro-creped paper sheet to impart uniform caliper thereto.

42. The process of claim 36, wherein said stratified moist paper web is formed by superimposing a second moist fibrous web onto a first moist fibrous web of similar fiber content.

43. The process of claim 36, wherein said stratified moist paper web is formed by superimposing a second moist fibrous web onto a first fibrous web of dissimilar fiber content.

44. The process of claim 43, wherein said first fibrous web is comprised primarily of relatively long papermaking fibers having an average length between about 0.08 and about 0.12 inches, said second fibrous web is comprised primarily of relatively short papermaking fibers having an average length between about 0.01 and about 0.06 inches, and the step of transferring said stratified moist paper web from said foraminous support medium to said drying/imprinting fabric is carried out by placing the surface of said web containing primarily short papermaking fibers in contact with the web supporting surface of said drying/imprinting fabric.

45. The process of claim 44, including the steps of thermally predrying said stratified moist paper web to a fiber consistency between about 30 and about 98 percent without disturbing the relationship of said web to said drying/imprinting fabric, and thereafter subjecting discrete portions of said thermally predried web to compaction between the knuckles of said drying/imprinting fabric and a non-yielding surface.

46. The process of claim 45, including the steps of adhering said thermally predried paper web to the surface of a dryer drum at discrete locations corresponding to the areas of discrete compaction by the knuckles of said drying/imprinting fabric, finally drying said paper web on the surface of said dryer drum, and creping said finally dried paper web during removal from said dryer drum by means of a doctor blade.

47. The process of claim 46, including the step of calendering said finally dried, creped paper sheet to impart uniform caliper thereto.

48. The process of claim 44, including the steps of finally drying said thermally predried paper web on said drying/imprinting fabric and thereafter subjecting said finally dried paper sheet to mechanical micro-creping upon removal from said fabric.

49. The process of claim 44, wherein the step of transferring said moist paper web from said foraminous support medium is carried out by applying vacuum to the undersurface of a foraminous drying/imprinting fabric having a diagonal free span which is greater than about one third times yet less than about 1.0 times the average fiber length in the short-fibered portion of said web, said diagonal free span also being less than about one third times the average fiber length in the long-fibered portion of said web.

50. A process for the manufacture of a soft, bulky and absorbent unitary paper sheet having a basis weight between about 8 and about 40 pounds per 3,000 square feet, as measured in an uncreped state, which comprises the steps of:

a. forming a moist paper web comprising at least two superposed stratified fibrous layers in contacting relationship;

b. supporting said moist paper web on a first foraminous fabric having between about 100 and about 3,600 mesh openings per square inch;

c. subjecting said moist paper web to a pressure differential while on said first foraminous fabric, thereby partially displacing the stratified fibrous layer in contact with said fabric in a plane perpendicular to said sheet in small discrete deflected areas corresponding to the mesh openings in said fabric;

d. superimposing a third fibrous layer on said moist paper web while said web is supported on said first foraminous fabric to form a unitary moist paper web having three stratified fibrous layers;

e. transferring said moist paper web from said first foraminous fabric to a second foraminous fabric having between about 100 and about 3,600 mesh openings per square inch by applying vacuum to the undersurface of said second foraminous fabric while said web is at a fiber consistency between about 5 and about 25 percent, thereby partially displacing the fibrous layer in contact with the web supporting surface of said fabric in small discrete deflected areas corresponding to the mesh openings in said fabric;

f. thermally predrying said moist paper web to a fiber consistency of at least about 30 percent without disturbing the relationship of said web to said second foraminous fabric; and g. final drying the paper sheet thus formed.

51. The process of claim 50, wherein the outermost fibrous layers of said three-layered web are comprised primarily of relatively short papermaking fibers having an average length between about 0.01 and about 0.06 inches and the central layer of said web is comprised primarily of relatively long papermaking fibers having an average length of at least about 0.08 inches, said three-layered web being formed by combining said fibrous layers with one another while at a fiber consistency not greater than about 20 percent.

52. The process of claim 50, including the steps of finally drying said thermally predried paper web on said second foraminous fabric and thereafter subjecting said finally dried paper web to mechanical micro-creping upon removal from said fabric.

* * * * *

UNITED STATES PATENT AND TRADEMARK OFFICE

CERTIFICATE OF CORRECTION

PATENT NO. : 3,994,771

DATED : November 30, 1976

INVENTOR(S) : George Morgan, Jr. and Thomas F. Rich

It is certified that error appears in the above-identified patent and that said Letters Patent are hereby corrected as shown below:

ABSTRACT, line 35, "mechaical" should read -- mechanical --.

Column 1, line 20, "lowdensity" should read -- low-density --.

Column 2, lines 22 and 23, "lowdensity" should read -- low-density --.

Column 4, line 17, "photoraphic" should read -- photographic --.

Column 6, line 57, "i.e." should read -- i.e., --.

Column 7, line 23, "prior at" should read -- prior art--.

Column 8, line 22, "faric" should read -- fabric --.

Column 10, line 19, "relaively" should read -- relatively --.

Column 11, line 39, "subjeted" should read -- subjected --.

Column 12, line 1, "prior at" should read -- prior art --.

Column 12, line 7, "formed, from" should read -- formed from --.

Column 12, line 30, "prior at" should read -- prior art --.

Column 12, line 42, "coaser" should read -- coarser --.

Column 13, line 3, "th" should read -- the --.

Column 13, line 24, "shortfibered" should read -- short-fibered --.

UNITED STATES PATENT AND TRADEMARK OFFICE

CERTIFICATE OF CORRECTION

PATENT NO. : 3,994,771

DATED : November 30, 1976

INVENTOR(S) : George Morgan, Jr. and Thomas F. Rich

It is certified that error appears in the above-identified patent and that said Letters Patent are hereby corrected as shown below:

Column 15, line 44, "224" should read -- 284 --.

Column 17, line 5, "sujected" should read -- subjected --.

Column 21, lines 11 and 12, "ASTM Standard Method No. 1388" should read -- *ASTM Standard Method No. 1388* --.

Column 21, line 30, "overhang, " ", can" should read -- overhang, "*l*", can --.

Column 21, line 40, "value, " "," should read -- value, "*l*", --.

Column 21, line 47, "= " " cm." should read -- = "*l*" cm. --.

Column 21, line 48, "and " " =" should read -- and "*l*" = --

Column 21, line 54, "= " " x" should read -- = "*l*" x --.

Column 23, line 10, "force, " " is" should read -- force, "*l*" is --.

Column 23, lines 35 and 36, "grams); " " is" should read -- grams); "*l*" is --.

UNITED STATES PATENT OFFICE

CERTIFICATE OF CORRECTION

Patent No. 3,994,771 Dated November 30, 1976

Inventor(s) George Morgan, Jr., et al.

It is certified that error appears in the above-identified patent and that said Letters Patent are hereby corrected as shown below:

DRAWINGS, Sheet 10, Figure 17, "224" directed to the vacuum box should read -- 284 --.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*